US007140137B2

(12) United States Patent
Chang

(10) Patent No.: US 7,140,137 B2
(45) Date of Patent: Nov. 28, 2006

(54) SPRING LOADED HOLDERS

(76) Inventor: Cherng Chang, P.O. Box 693, Miamisburg, OH (US) 45343

( * ) Notice: Subject to any disclaimer, the term of this patent is extended or adjusted under 35 U.S.C. 154(b) by 30 days.

(21) Appl. No.: 10/677,017

(22) Filed: Oct. 1, 2003

(65) Prior Publication Data

US 2005/0050787 A1 Mar. 10, 2005

Related U.S. Application Data

(60) Provisional application No. 60/501,372, filed on Sep. 9, 2003.

(51) Int. Cl.
*A47G 1/06* (2006.01)

(52) U.S. Cl. ..... 40/794; 40/721; 40/611.12; 281/45; 16/296; 24/517

(58) Field of Classification Search ..... 40/721, 40/790, 794, 765, 795, 611.02, 611.11, 611.12, 40/107, 658, 647, 666, 652; 281/45; 16/293, 16/296; 24/67.7, 505, 517, 489
See application file for complete search history.

(56) References Cited

U.S. PATENT DOCUMENTS

| | | | | | |
|---|---|---|---|---|---|
| 387,779 | A | * | 8/1888 | Erschell | 40/792 |
| 957,539 | A | * | 5/1910 | Berkebile | 221/26 |
| 1,601,479 | A | * | 9/1926 | Parda | 40/721 |
| 1,626,150 | A | * | 4/1927 | Parda | 40/721 |
| 2,500,468 | A | * | 3/1950 | Postell | 24/67.7 |
| 2,510,629 | A | * | 6/1950 | Golden | 40/721 |
| 2,649,799 | A | | 8/1953 | Spertus | |
| 2,996,774 | A | * | 8/1961 | Sutton | 24/67.7 |
| 3,018,780 | A | * | 1/1962 | Greenblatt et al. | 402/69 |
| 3,391,420 | A | | 7/1968 | Anderson | |
| 3,670,370 | A | * | 6/1972 | Goodwin | 24/67.7 |
| 4,439,888 | A | | 4/1984 | Merillat | |
| 4,605,246 | A | * | 8/1986 | Haas et al. | 462/78 |
| RE33,443 | E | | 11/1990 | Ackeret | |
| 5,095,641 | A | * | 3/1992 | Dahl | 40/721 |
| 6,293,038 | B1 | | 9/2001 | Chang | |

FOREIGN PATENT DOCUMENTS

| | | |
|---|---|---|
| EP | 0346177 | 12/1989 |
| FR | 2706002 | 12/1994 |

OTHER PUBLICATIONS

1438160 Jun. 3, 1976 Schindler (GB).

* cited by examiner

*Primary Examiner*—Gary C. Hoge

(57) ABSTRACT

A spring loaded holder with a holder plate which is rotatable between a deactivated zone and an activated zone. When the holder plate is manually moved to the activated zone a cam action will be activated to apply a holding force to the holder plate for firmly holding objects of varied thickness. Such holders can be installed in a picture frame for holding a stack of art sheets. For a vertically mounted art frame a displayed art sheet smaller than the internal size of the art frame can also be held by this holder without shifting. Unused art sheets and associated mat boards can be mounted along with the displayed art sheet. Since all art sheets and mat boards are kept together, the change of art sheet display can be easily achieved any time if desired. Such picture frame can also be used for displaying and storing expired calendar books. The holder can be further modified and used in a variety of holding boards including fun boards, bulletin boards and poster boards. It is proposed that an ensemble including an art frame of the present invention and a mat board of standard size and a plurality of art sheets standardized to match the art frame and the mat board be sellable in one business transaction or one pseudo business transaction.

18 Claims, 12 Drawing Sheets

52
78
80
30
42
34
56
54
58
46
67
70
60
62
74
54
66
72
68
50
48
34
64
44

FIG 8a
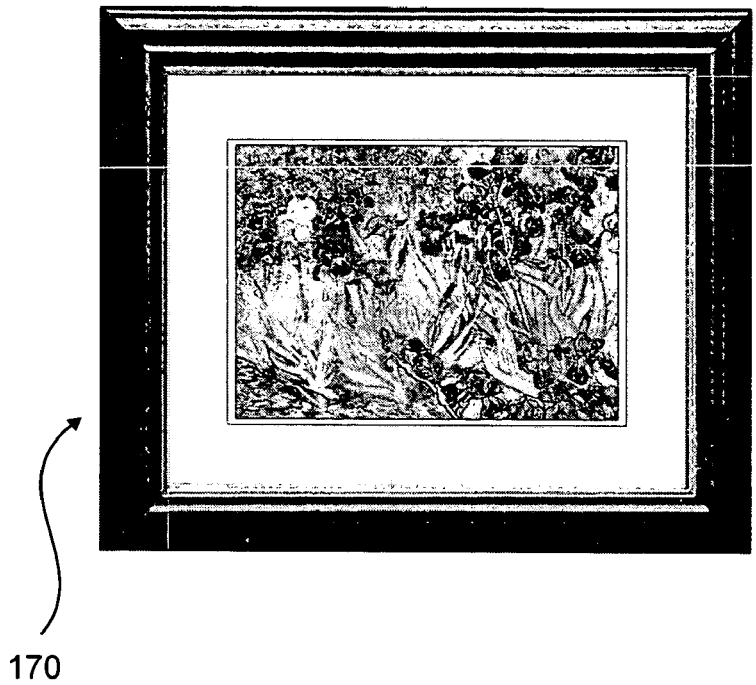
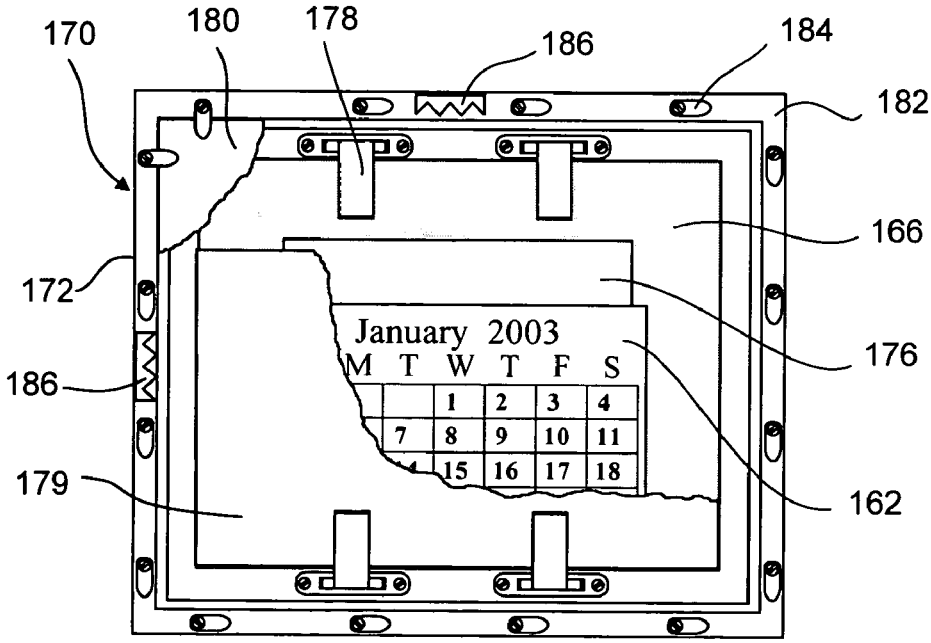
FIG 8b

SPRING LOADED HOLDERS

CLAIM PRIORITY

U.S. Provisional Patent Application No. 60/501,372, filed Sep. 9, 2003

BACKGROUND OF THE INVENTION

This invention relates in general to holding and displaying sheet arts, and more specifically, to holding devices such as picture frames and boards for holding and displaying the sheet arts. Here the sheet arts may include art sheets, photographs, printer outputs, and any sheet materials that are to be displayed.

Picture frames, or simply termed frames in the present discussion, can be divided into two different types of frames depending on its commercial transaction. The first type of frame is a photo frame or commonly still termed as picture frame. It is usually sold as a unit by itself without the art sheet. The buyer generally uses such frame for framing a personal photo. But occasionally such frames are also used to frame a non-photo art sheet such as a high school diploma.

Most photo frames are user friendly to a certain degree. It generally allows user to reuse this photo frame for displaying other photos or art sheets. Most photo frames can only hold one or two photos, and is not flexible enough to hold a large number of photo sheets. The retainers used in these photo frames such as turn buttons are passive retaining means and is not strong enough to hold without shifting a photo which is smaller than the internal size of the frame. Adhesive must be used to glue this photo to the back of a mat board. This will likely result in some damage to the photo or the mat board. It will also prevent the same mat board to be later used for other photos.

Some photo frames use one or more card boards as spacers, which can be removed for allowing more photos to be stored. But unless the additional photos added equal the card boards removed in thickness the photos mounted will not be firmly held by the passive turn buttons The second type of frames is an art frame. This art frame is usually sold as part of a pre-framed art or custom made at a framing shop after an art sheet is acquired. The primary function of this art frame is for displaying and protection of the framed art sheet. This is OK if the art sheet is an original art or expensive limited edition reproduction of an original art. In view of its high cost the accompanied art frame more likely will serve this art sheet indefinitely and will not be reused again.

But in many cases the art frame will cost more than the art sheet it intends to display and protect. For example, an official reproduction of the famous Mona Lisa print (50 cm×70 cm; 20"×27") can be purchased from Louvre at about the cost of a typical dinner for two. But it may cost several times of that to obtain an art frame to properly frame such a print.

Largely owing to the recent advance of printing technology and computer based graphics, the reproduction of most original sheet art can be beautifully made at low cost. An archive grade ink jet color reprint can endure for one hundred years or more under normal photo frame display condition. Art sheet reproduction by good commercial grade but low cost mass printing may last even longer.

In spite of this print reproduction advancement, the present art frame industry is still placing main emphasis on the protection of the displayed art sheets. This is done at the expense of one other important consideration for an art frame, its reusability. This is done even the main cost in a framed art is the art frame itself.

As a general rule one only needs to keep enough frames to fill his or her household for display. One may continue to acquire more art sheets thereafter. In view of the significant cost of a frame, it is desirable that an existing art frame be made user friendly which would enable user to reuse the same frame for more other acquired art prints. But this is very difficult in the present practice.

Many people purchase a framed art out of impulse. After six months of display there is a strong urge to replace this displayed art. One would wish to know that this art frame can be reused for other art sheets display. A reusable art frame would also be desirable to a person who is interested in changing the displayed arts once in a while as a way to refresh the household wall decoration.

In most framed arts, the art sheet assemblies are held in the art frames with the use of brads or staples. Such retainers are generally not reusable and must be removed for mounting any new art sheets. Removing old retainers and installing new retainers will normally need special equipments and most users are not equipped or trained for such practice. The use of a kraft paper glued to the back of the frame will further intimidate any attempt to reuse the art frames.

As a picture frame is adapted for displaying more than one art sheet assembly, the storage of the unused art sheet assemblies including its mat boards will become a problem. Most picture frame only has space enough to hold one or rarely two art sheet assemblies. Since most wall mounted art sheets are large in size and it is difficult to find alternate space to store these unused art sheet assemblies for later use. If this problem is not resolved the user is unlikely to reuse the same frame for other art sheet display. A common consequence is increasing number of unused framed arts stored in attics or basements.

A calendar such as a monthly calendar normally has twelve calendar pictures, one for each month of the year. But these twelve calendar pictures are not twelve loose and separate pictures but are bound together in a book. Federal copy right law prohibits having one calendar picture removed and displayed separate from the rest of the copy. There is no viable and generally accepted way to display such calendars once it become expired. It is a waste of resource considering that most calendars carry elegant calendar pictures worthy of at least occasional display.

Several conventional boards such as clipboards and bulletin boards offer an alternative way to display art sheets inexpensively. But their use has not been popular in the market place. Some of such boards use a spring clip which is hard to operate and not visually pleasing for display. It must be held constantly against the spring force in the open position during the entire sheet unloading and loading processes. Many bulletin boards use pin or glue which are not secure way for holding sheets to be displayed. This is especially true for a multiple page stack which must be flipped through while mounted on the bulletin board on a wall.

SUMMARY OF THE INVENTION

In the present invention a novel spring loaded holder is disclosed. This holder has a holder base, a holder plate and a cam assembly comprising a plunger and one or more compression springs. The holder plate is rotatable between a deactivated zone and an activated zone. When this holder plate is manually moved to the activated zone a cam action will be activated to apply a holding force to the holder plate for firmly holding a variety of sheet stacks of different thickness or other objects.

A novel picture frame employing one or more of the above-described holders is next disclosed. A stack of art sheets including the displayed art sheet assembly and many stored art sheet assemblies can be securely held by the holders of this picture frame. This picture frame is very user friendly. The holders are very easy to operate. Practically any art sheet smaller than the picture frame, if needed, can be firmly held and displayed in this picture frame as long as a mat board of appropriate opening size is available. There is no need to glue a smaller art sheet to the back of the mat board. Since all art sheets and mat boards are kept together, the change of the art sheet display can be easily done any time if desired.

It is proposed that a framed art ensemble including an art frame and a mat board of standard size and a plurality of art sheets standardized to match the art frame and the mat board be sellable in one business transaction or one pseudo business transaction. The multiple art sheets with size standardization and the art frame with spring loaded holding means are put together to create a synergetic benefit in the mind of consumer. It offers the buyer an immediate opportunity to practice and appreciate the display change feature provided by the art frame of the present invention. It will undoubtedly be a strong incentive and improve the sale of this framed art ensemble.

The picture frame of the present invention can also be employed for a new application of displaying and storing expired monthly calendar books. The calendar book is simply folded back to expose the calendar picture to be displayed behind a mat board with appropriate opening size. Any unused calendar books can be stored in the picture frame and redisplayed anytime if desired.

The holder of the present invention can also be applied to a variety of boards including fun boards, bulletin boards, and poster boards. Special attention are paid for ease of operation and safety mainly applicable to young users. Improvement on the holder structure design is made so that all such boards are always operated at or near maximum torque inherent to the holders.

BRIEF DESCRIPTION OF THE DRAWINGS

FIG. 8 shows the front elevational view and back elevational view of the picture frame mounted with the two calendar books of FIG. 7.

REFERENCE NUMERALS IN DRAWINGS

| | | | | |
|---|---|---|---|---|
| FIGS. 1–4 | 30 | holder | 32 | picture frame |
| | 34 | wood screws | 36 | frame body |
| | 38 | frame rabbet | 40 | frame step |
| | 42 | stationary holder base | 44 | rotatable holder plate |
| | 44' | first extreme position of the holder plate | 44 | |
| | 44" | second extreme position of the holder plate | 44 | |
| | 46 | cam assembly | 48 | plunger |
| | 50 | compression springs | 52 | pins |
| | 54 | side flanges | 56 | curls or sleeves |
| | 58 | center flange | 60 | right angle bent |
| | 62 | curl or sleeve | 64 | cut out |
| | 66 | contact surface | 67 | plunger wells |
| | 68 | ramp surface | 70 | recesses |
| | 72 | groove | 74 | depression or indent |
| | 76 | bump | 78 | pin head |
| | 80 | pin stem | 82 | sheet stack |
| | 84 | sheet stack | 86 | holder plate lifter |
| | 88 | holder | 90 | pin head |
| | 92 | holder plate | 94 | center plate |
| | 96 | opening | 98 | rod member |

-continued

Figure 11:
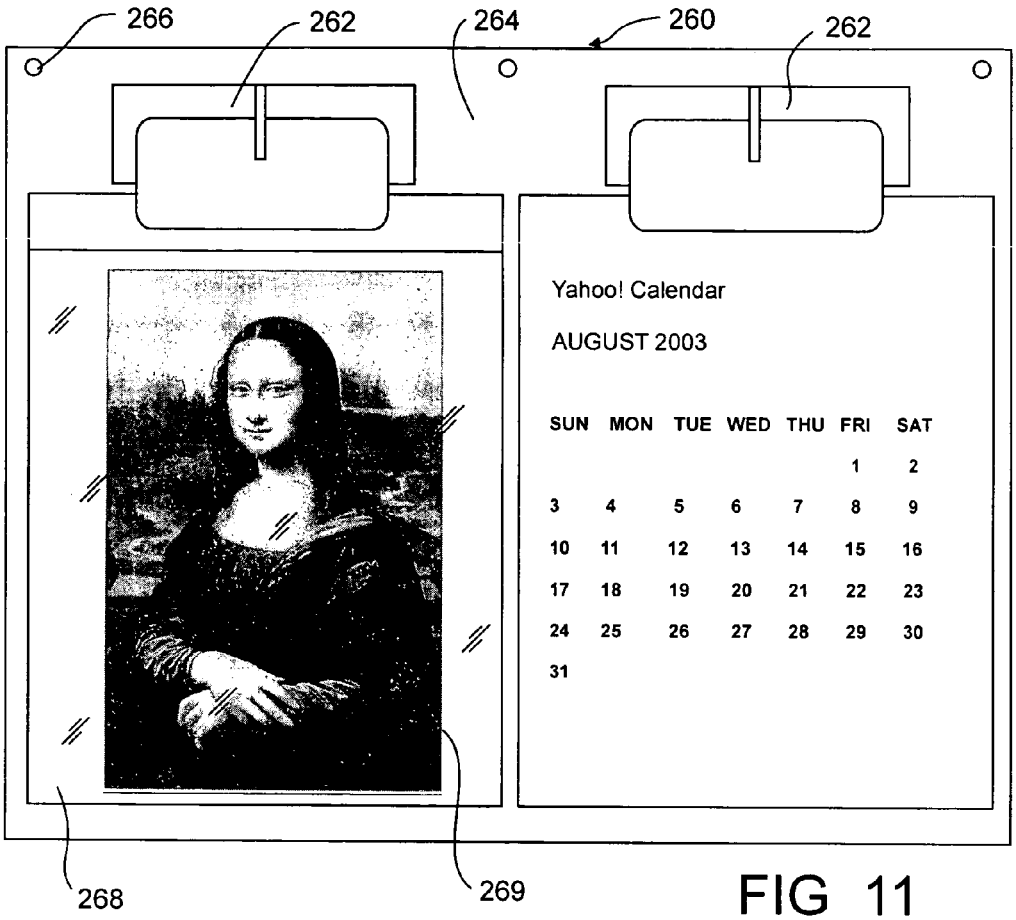
FIG. 11 is an elevational view of a bulletin board of the present invention, with two holders of FIG. 9, for holding and displaying two art sheets.
Figure 5:
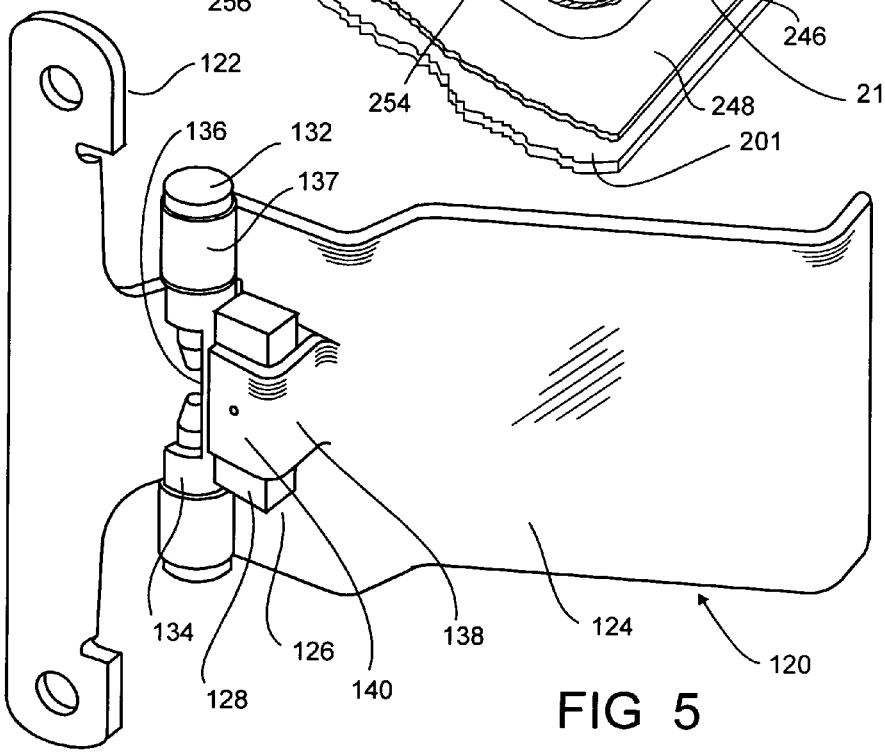
FIG. 5 is a perspective view of a second embodiment of the holder of the present invention.
Figure 6:
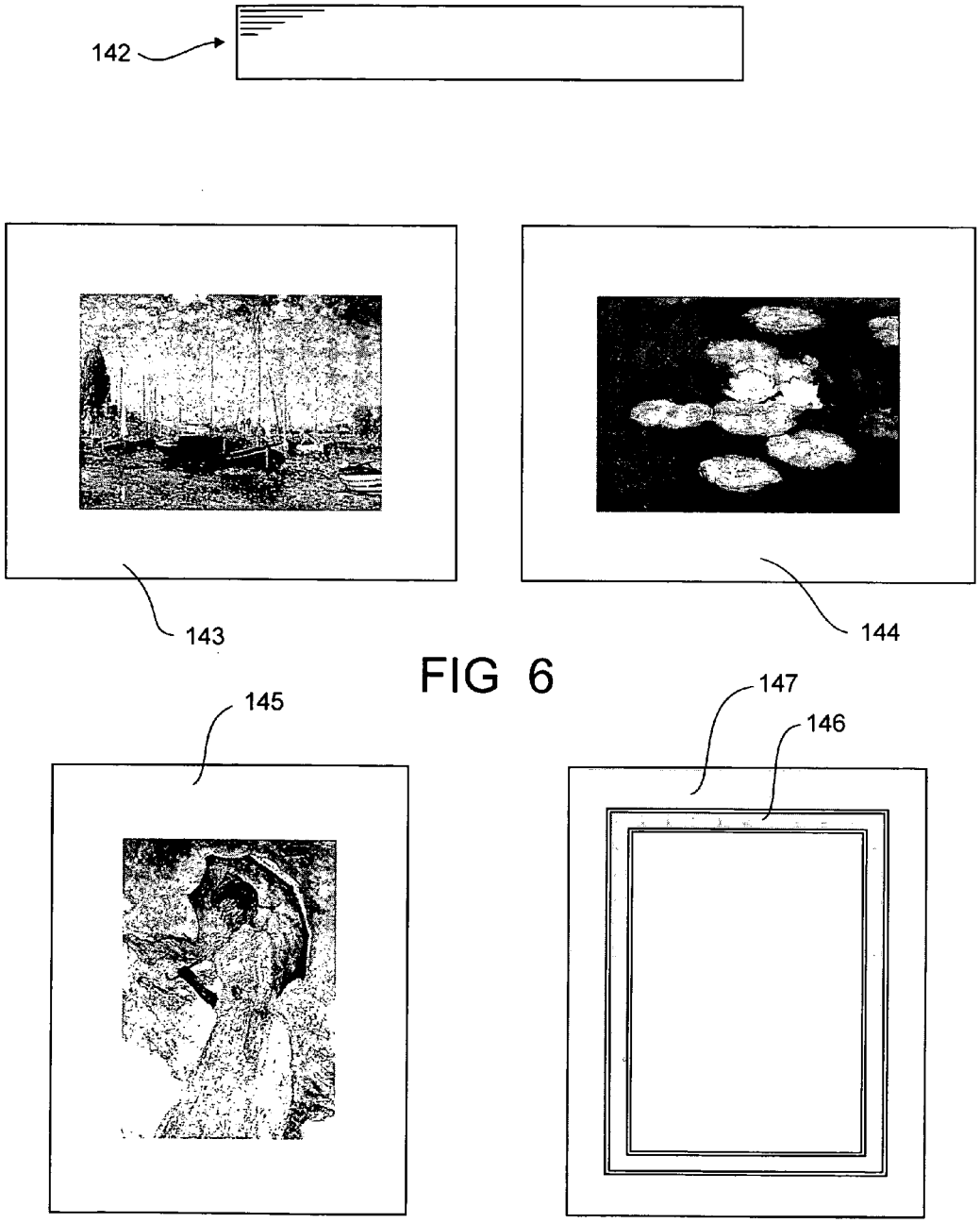
FIG. 6 show a reusable art frame with spring loaded holders, three art sheets, and two mat boards grouped together as an ensemble.
Figure 7:
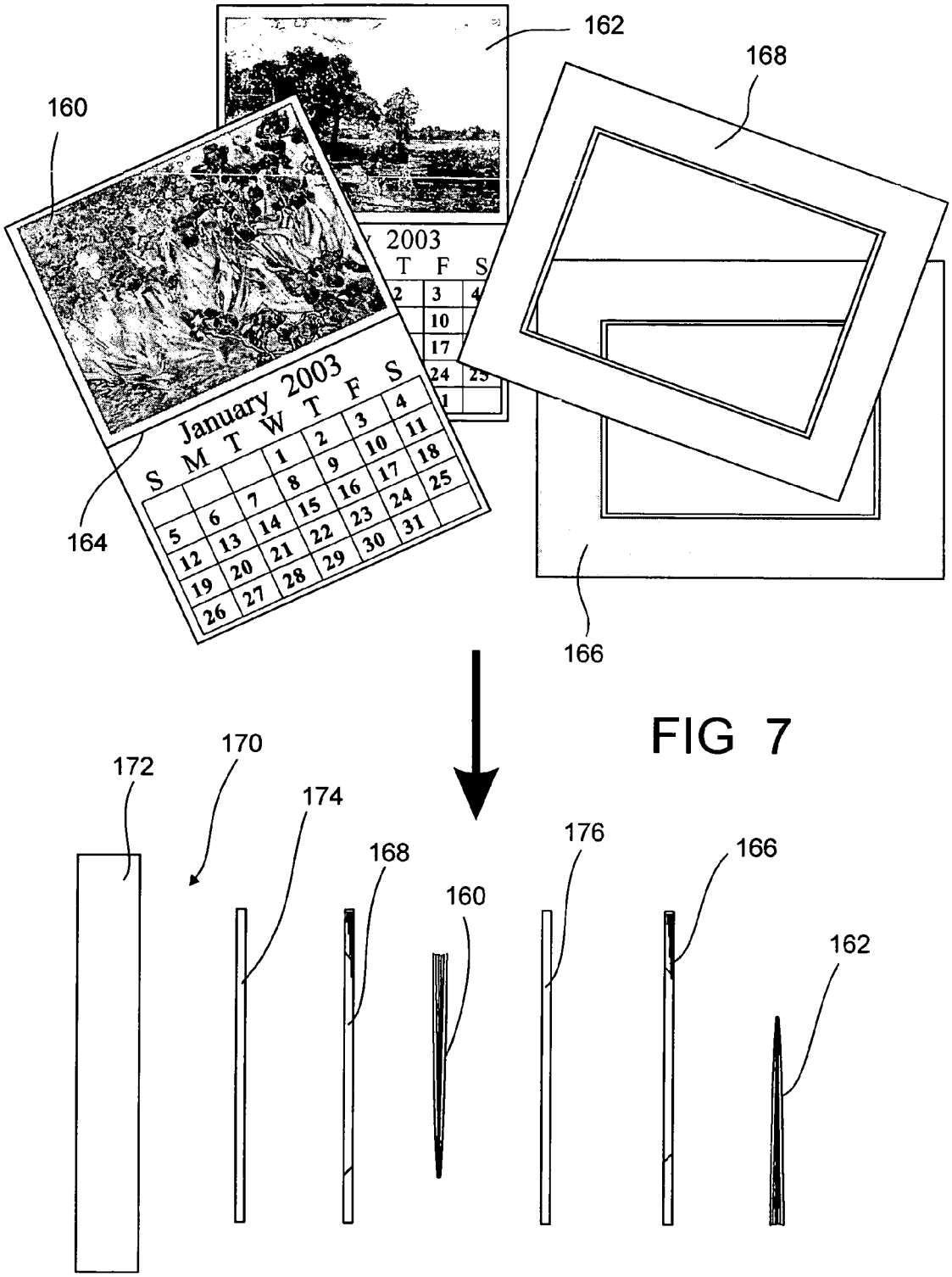
FIG. 7 shows the elevational view and side view of two calendar books and two mat boards, to be mounted in a picture frame, which is shown disassembled.
Figure 12:
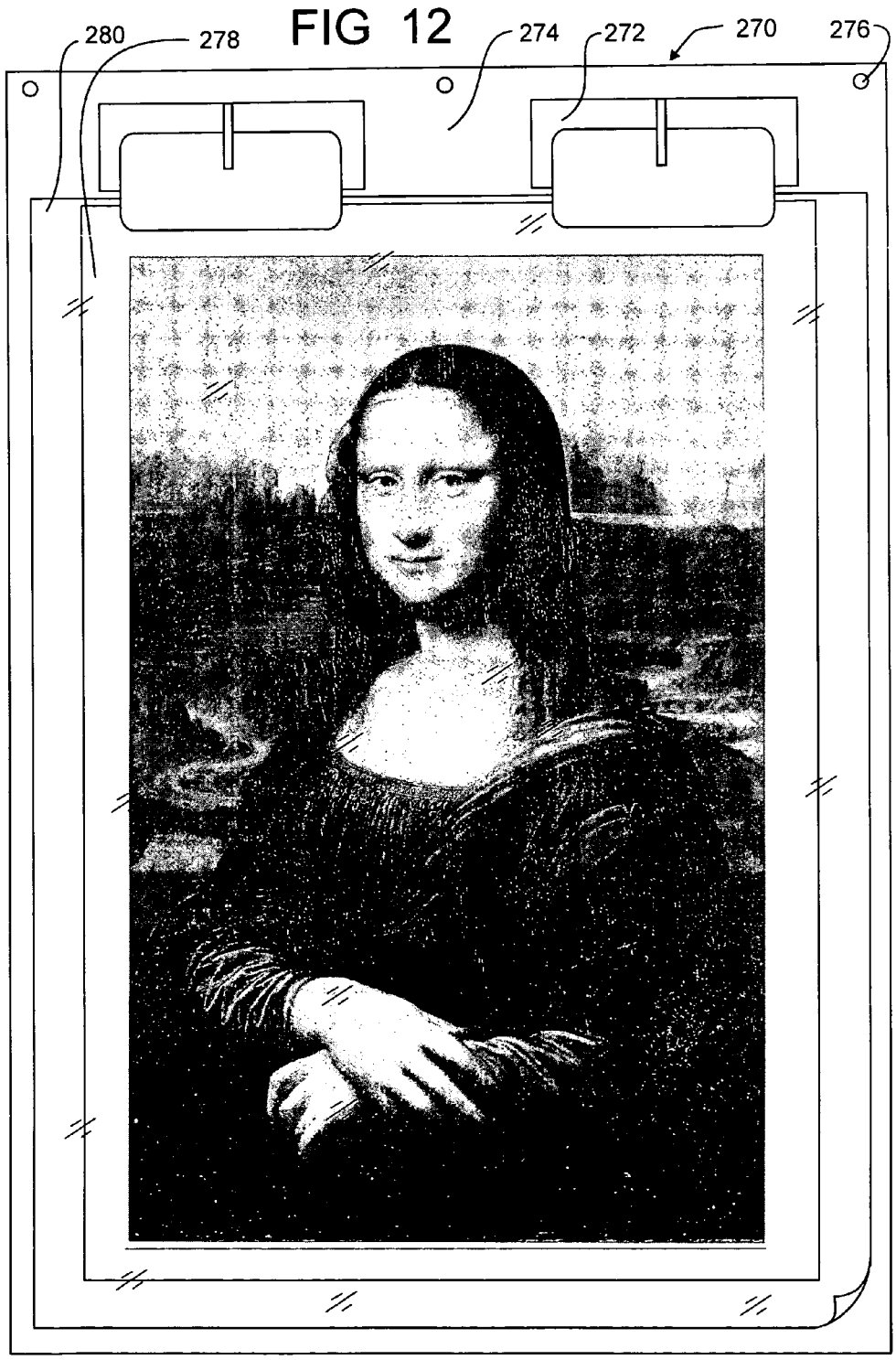
FIG. 12 is an elevational view of a poster board of the present invention, with two holders of FIG. 9, for holding and displaying a poster sheet.
Figure 13:
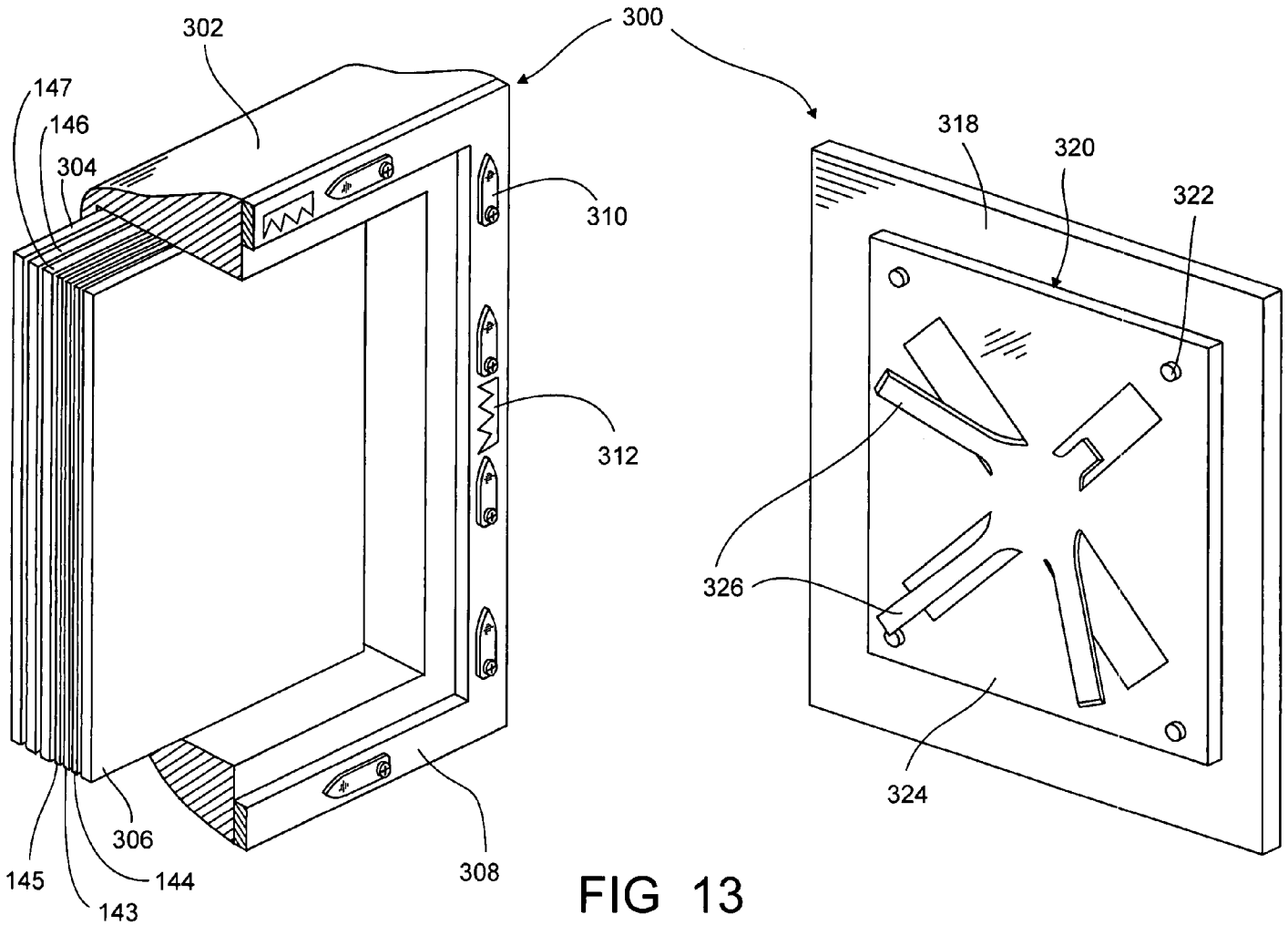
FIG. 13 is a perspective view of an art frame with a leaf spring holder for holding a plurality of art sheets with size standardization.
Figure 14:
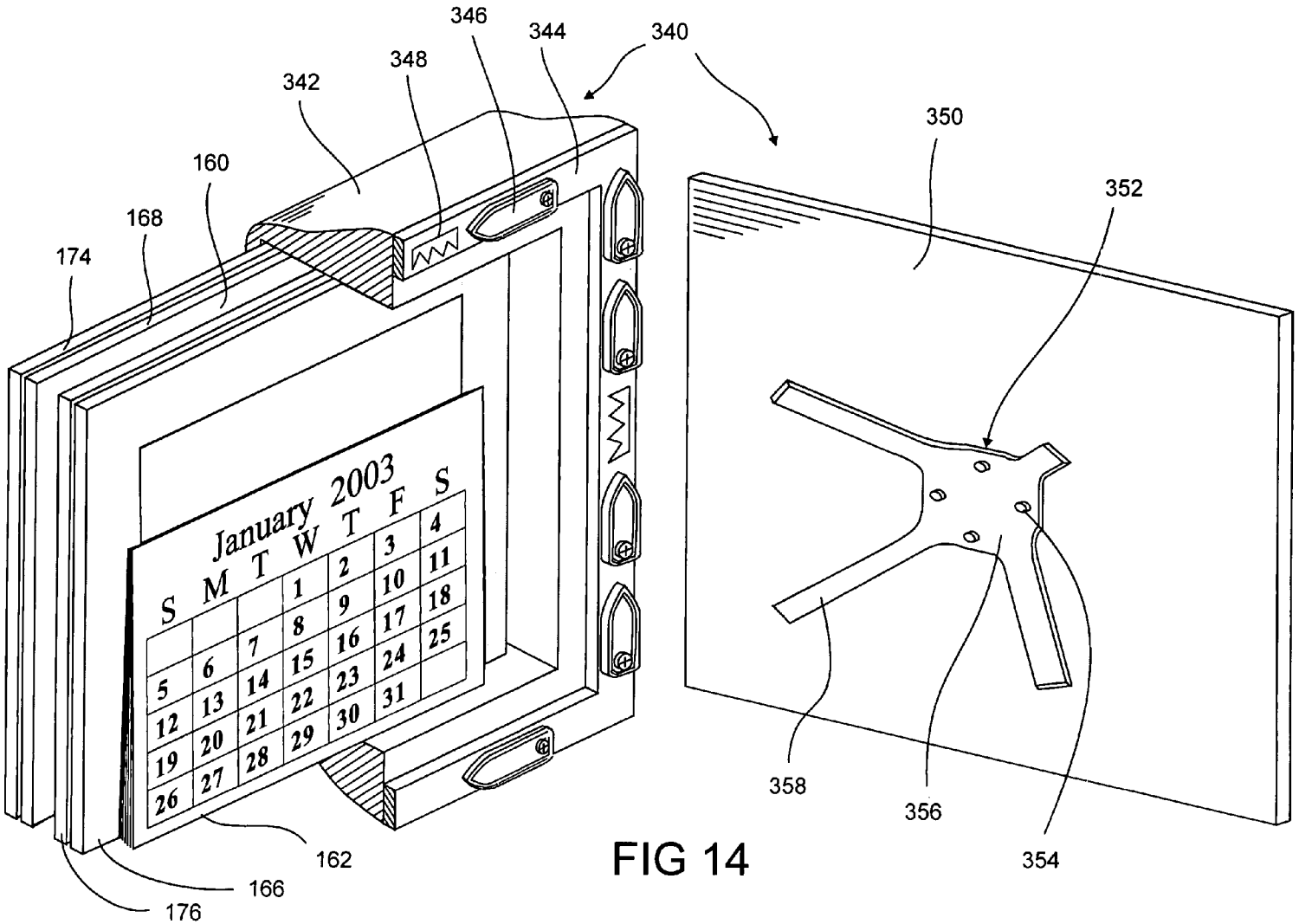
FIG. 14 is a perspective view of a picture frame with a leaf spring holder for displaying and storing expired calendar books.

| | | | | |
|---|---|---|---|---|
| | 100 | rod member | 102 | elbow |
| | 104 | elbow | | |
| FIG. 5 | 120 | holder | 122 | stationary holder base |
| | 124 | rotatable holder plate | 126 | cam assembly |
| | 128 | plunger | 130 | compression springs |
| | 132 | pins | 134 | curl or sleeve |
| | 136 | cut out | 137 | outer curls or sleeves |
| | 138 | center flange | 140 | right angle bent |
| FIG. 6 | 142 | art frame | 143 | Monet art sheet |
| | 144 | Monet art sheet | 145 | Monet art sheet |
| | 146 | mat board | 147 | mat board |
| FIGS. 7–8 | 160 | expired calendar book | 162 | expired calendar book |
| | 164 | center line | 166 | mat board |
| | 168 | mat board | 170 | picture frame |
| | 172 | frame body | 174 | frame glass |
| | 176 | backing plate | 178 | holders |
| | 179 | second backing plate | 180 | back board |
| | 182 | frame periphery | 184 | turn buttons |
| | 186 | hangers | | |
| FIGS. 9–12 | 200 | fun board | 201 | board |
| | 202 | holder | 204 | cover |
| | 206 | stationary holder base | 208 | rivets |
| | 210 | side flanges | 212 | curls |
| | 214 | center flange | 216 | right angle bent |
| | 218 | rotatable holder plate | 220 | curl |
| | 222 | pins | 224 | cam assembly |
| | 226 | plunger | 228 | compression springs |
| | 230 | plunger wells | 232 | grooves |
| | 234 | bumps | 236 | leverage plate |
| | 238 | shark's fin | 240 | shark's tail |
| | 242 | flange | 244 | rivets |
| | 246 | clearance | 248 | art sheet |
| | 250 | slot opening | 252 | hanging holes |
| | 254 | robbery material | 256 | rivets |
| | 260 | bulletin board | 262 | holders |
| | 264 | board | 266 | hanging holes |
| | 268 | clear pocket | 269 | Mona Lisa print |
| | 270 | poster board | 272 | holders |
| | 274 | board | 276 | hanging holes |
| | 278 | Mona Lisa poster | 280 | transparent and soft sheet |
| FIG. 13 | 300 | art frame | 302 | frame body |
| | 304 | frame glass | 306 | backing plate |
| | 308 | frame peripheral | 310 | turn buttons |
| | 312 | hangers | 318 | back board |
| | 320 | spring loaded holder | 322 | rivets |
| | 324 | base plate | 326 | compression leaf springs |
| FIG. 14 | 340 | picture frame | 342 | frame body |
| | 344 | peripheral | 346 | turn buttons |
| | 348 | hangers | 350 | back board |
| | 352 | spring loaded holder | 354 | rivets |
| | 356 | spring base | 358 | leaf springs |

DETAILED DESCRIPTION

FIGS. 1–4

Figure 1:
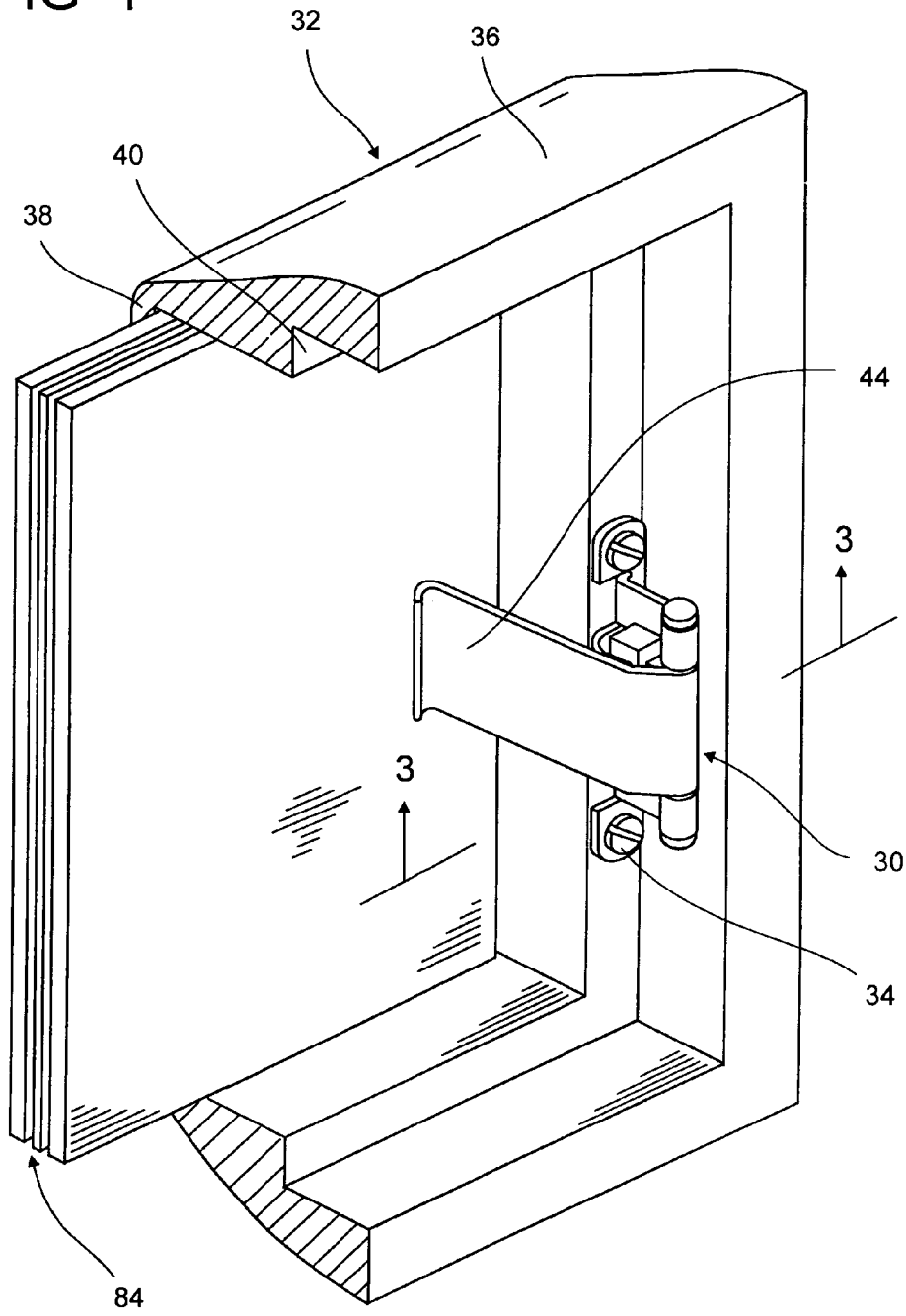
FIG. 1 is a perspective view of a first embodiment of the holder of the present invention, as it is mounted on a picture frame which has a portion cut off.

FIGS. 1–4 show a first embodiment of the spring loaded holder of the present invention. The holder 30 is shown in FIG. 1 mounted on a picture frame 32 with the use of two wood screws 34. This picture frame 32 has a frame body 36, and a portion of which is cut off to provide a cross sectional view of this frame body. It is seen here that in addition to the conventional frame rabbet 38 the frame molding of the frame body 36 has one additional step 40. As shown in FIG. 1 this step 40 is needed for the mounting of the holder 30.

Figure 2:
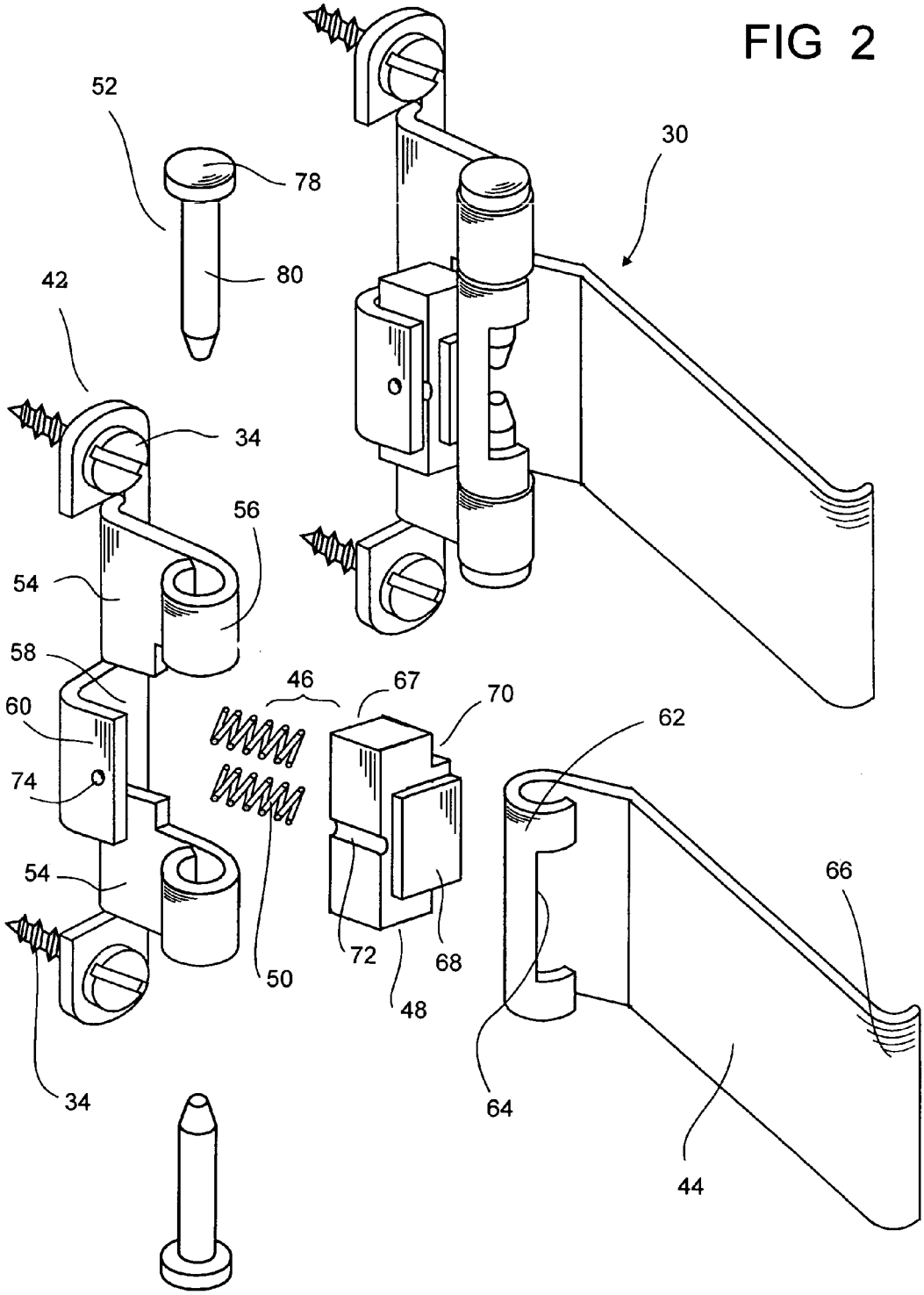
FIG. 2 shows the perspective views of the same holder of FIG. 1, in more details, both assembled and disassembled.

FIG. 2 provides more details of this holder 30 by showing it both disassembled and assembled. This holder 30 mainly comprises a stationary holder base 42, a rotatable holder plate 44, a cam assembly 46 which may include a plunger 48 and two compression springs 50, and two pins 52.

The stationary holder base 42 is typically formed by sheet metal stamping and bending process. At two ends of this holder base 42 are two mounting holes for the entry of the two wood screws 34 for mounting the holder base 42 on the frame body 36 as shown in FIG. 1. Next to the mounting holes are two side flanges 54 which are bent as shown. The end of each side flange 54 is curled to form a curl or sleeve 56. Located between the two side flanges 54 is a center flange 58. The end of the center flange 58 is bent to form a right angle bent 60 which is in parallel with the two side flanges 54.

The rotatable holder plate 44 is also formed to the shape as shown in the figure by a metal sheet stamping and bending process. The back end of this holder plate 44 is also curled to form a curl or sleeve 62. The middle section of this curl 62 is cut back to form a cut out 64. The edge of this cut out 64 is preferably rounded which will be clear at discussion below. The front end of this holder plate 44 is also slightly curled to form a smooth contact surface 66.

As seen in FIG. 2, located between the stationary holder base 42 and the rotatable holder plate 44 is the cam assembly 46 which includes the plunger 48 and two compression springs 50. The plunger 48 is a molded plastic block of high mechanic strength. One side of this plunger 48 is molded to form two plunger wells 67 to receive the two compression springs 50. The opposite side of this plunger 48 is a raised ramp surface 68. Two recesses 70 are formed on the upper and lower right corners of the plunger block 48. A horizontal groove 72 is carved on the left side of the plunger 48. As seen in the figure a depression or indent 74 is formed on the outside surface of the right angle bent 60 of the center flange 58. This will create a bump 76 on the opposite side of the right angle bent 60. As will be discussed below the groove 72 will be slidably engaged with the bump 76 after the holder 30 is assembled.

The last items to be described are the two metal pins 52. Each pin 52 has a pin head 78 and a pin stem 80.

The assembling of the holder 30 is started by placing the cam assembly 46 in the space between the two side flanges 54 and the center flange 58. The right side portion of the plunger 48 between the two recesses 70 is held between the two side flanges 54 of the holder base 42. The horizontal groove 72 on the left side of the plunger 48 is held by the bump 76 of the center flange 58. The only movement of the plunger 48 in this confined space allowed is the horizontal reciprocal motion of the plunger 48 against the compression springs 50 as the groove 72 is sliding on the bump 76.

The holder plate 44 is next placed between the two curls 56 of the holder base 42. The curl 62 of the holder plate 44 is pressed against the ramp surface 68 of the plunger 48 until the curl 62 is lined up with the curls 56. At this time the two pins 52 are then inserted into the curls 62 and 56 which completes the holder assembling process. Obviously, the above description only serves for the purpose of illustration only, and in realty each holder will come factory pre-assembled and ready for use.

Figure 3:
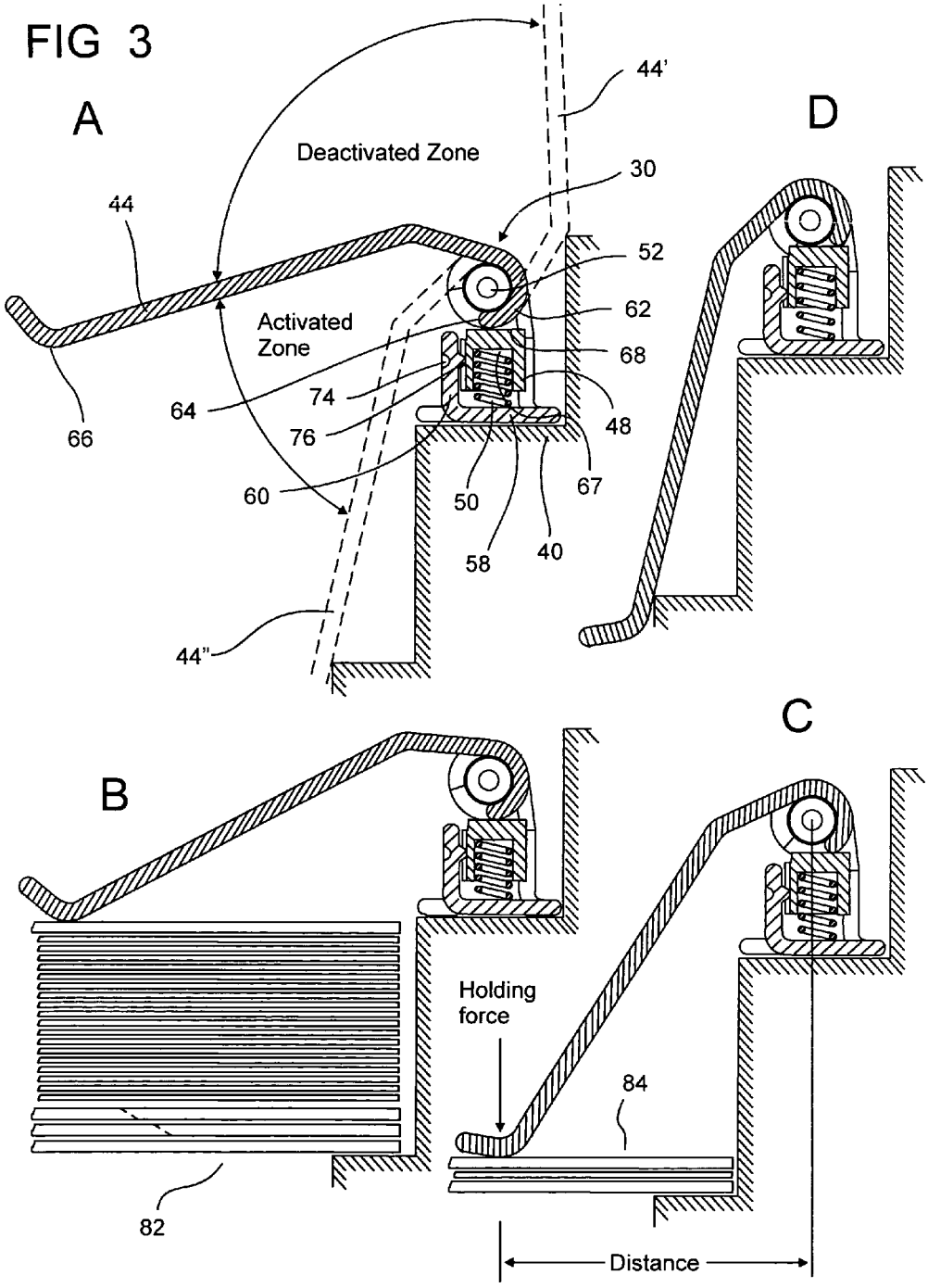
FIG. 3 are the sectional views of the holder of FIG. 1, taken substantially on a horizontal plane containing the line 3—3, as the holder plate is rotated to four different positions.

FIG. 3 discloses the details of the operation of the holder 30 of the present invention. Due to physical restriction imposed by the frame body 36, the holder plate 44 can only be rotated between the two extreme positions as indicated by the dash line 44' and 44".

It is assumed that the rotatable holder plate 44 is first at the first extreme position 44'. At this time the compression springs 50 will constantly exert an upward pressure through the plunger 48 onto the curl 62 of the holder plate 44. This pressure only serves to increase the friction between the curl 62 and the ramp surface 68 against which the holder plate 44 can still freely rotate and rest as desired. This region is defined as deactivated zone within which the cam action is not activated.

It is noted that the edge line of the cut out 64 in the curl 62 is rounded and is shown as a half circle in its cross section. Once the holder plate 44 is rotated to a critical position as shown in FIG. 3A this cut out edge line 64 begins in contact with the ramp surface 68. Any slight counter clockwise push of the holder plate 44 will initiate the cam action. At this time the upward pressure by the compression springs 50 will impart a torque through the cut out edge line 64 to the holder plate 44. This torque will cause the holder plate 44 to rotate counter clockwise indefinitely until the holder plate 44 is stopped by the mounted sheet stacks 82, 84 or the frame body 36 as shown in FIGS. 3B, 3C, and 3D, respectively.

The region between the critical position of the holder plate 44 and the second extreme position 44" as seen in FIG. 3A is defined as activated zone. Any time the holder plate 44 is manually moved into this region the cam action will be activated and the holder plate will rotate counter clockwise by itself until it is stopped by the sheet stack or the frame body.

Once the holder plate 44 is stopped by the sheet stacks 82 or 84, the torque applied to the holder plate 44 by the cam action will still exist. This is the source of the holding force provided by the holder 30 of the present invention.

As seen in FIGS. 3B and 3C, when the holder plate 44 is stopped by the sheet stack, the torque generated by the cam action will be continuously applied to the sheet stack. Referring to FIG. 3C, this torque can be expressed by the product of the downward holding force and Distance, the distance between the holder plate contact point and the axis of rotation. This holding force is the actual force holding the sheet stack together.

It should be noted that when the frame is positioned face down as shown in FIG. 3C, the weight of the holder plate 44 may also contribute some force in addition to the holding force from the torque. But since the frame is normally hung upright, no additional holding force will be contributed by the weight of the holder plate 44.

The holding force applied to the sheet stack 82 in FIG. 3B is much less than the holding force applied to the sheet stack 84 in FIG. 3C. The reason for this reduced holding force is twofold. First, the torque generated by the cam action in the case of FIG. 3B is less than the torque generated in the case of FIG. 3C. Second, for a given torque, the produced holding force is reduced when the distance (Distance) is increased, as is the case of FIG. 3B.

In order to provide adequate holding force in the case of full load as shown in FIG. 3B, the cam assembly 46 must be made strong enough. This is usually achieved by choosing the compression springs 50 of strong compression force. Short of that, it can be recommended that the filling of the sheet stack be limited to only half or 70% full load. It is always possible that the frame depth be made deep enough so that even a half load is adequate for most application.

In the above discussion it is assumed that the cut out edge line 64 is perfectly round with its cross section appeared as a half circle. But if the cut out edge line 64 is rounded but not perfect as a half circle the cam action will still happen but its onset point may not be the same as that shown in FIG. 3A. The cam action will also happen even if the cut out 64 has a square edge but the cam action can be very unsmooth. In certain unusual situations in which the cut out edge line 64 is of very rugged shape the cam action may be stopped abruptly in half way and a little hand push will be needed to continue the cam action.

To open the holder plate 44 from its closed position in FIG. 3B or 3C, one needs to pull up the holder plate 44 against the torque exerted by the cam action until the holder plate 44 is rotated to beyond the critical position as shown in FIG. 3A. Once entering the deactivated zone the torque will disappear, and the holder plate 44 can be further rotated until the frame body 38 is clear for removal of the art sheet assembly.

FIG. 3C represents the minimum number of sheets can be allowed in the present picture frame 32. The sheet stack 84 comprises one frame glass, one art sheet to be displayed, and one backing plate. In FIG. 3B the sheet stack 82 comprises one frame glass, one backing plate and any number of art sheets/mat boards until the sheet stack reaches the rim. The maximum sheet stack thickness can be made 1" or more. In any case the backing plate employed must be rigid which will not form indent under the pressure of the holder plate 44. This will allow the holding force to be equally spread over the entire area of the backing plate.

In FIG. 1, for the purpose of illustration only one holder 30 is shown in the picture frame 32. For smaller frame a minimum of two holders is required. These two holders can be installed either in the top and bottom sides of the frame or in the left and right sides of the frame. For larger frames a total of two pairs of holders is recommended. These two pairs can be installed either in the top and bottom sides of the frame or in the left and right sides of the frame. But rarely more than four holders will be required no matter how large the picture frame is. It is more economical to choose larger and stronger holders instead of increasing its number.

The picture frame of the present invention offers many advantages over the conventional picture frames. Most conventional picture frames use passive retainers such as brads, staples, and turn buttons which can not positively hold a smaller art sheet on display in the frame without shifting in the frame. On the other hand, the spring loaded holder in the present picture frame, with its strong holding force, will firmly hold the art sheet on display without shifting. There is no need to glue a smaller art sheet to the back of the mat board for display.

The second important advantage of the present picture frame is in its ease of changing the art sheet display. It is just a matter of opening each holder, rearranging the art sheet and mat boards, and shut close the holders. Since all the mat boards are not glued to the art sheets they can be freely chosen for the next display. With the availability of mat boards of appropriate opening size virtually any art sheets of size smaller than the internal size of the picture frame can be displayed.

The last but not least advantage of the present picture frame is its capability in storing unused art sheets and associated mat boards, etc. All the unused art sheet assemblies are just placed behind the art sheet assembly to be displayed and held in place by the holders. Since all art sheets are kept together in one place, the user will be encouraged to change the display any time desired as a way to refresh the home decoration. No more unused frames put away in the attics or basements.

The holder 30 of the present invention is elegant in its shape and design. It is structured in such a way which makes its operation so intuitive, simple and requires no explanation. The division of the deactivated zone and activated zone is ideally suited for the needs of a picture frame. The cam assembly provides such a powerful cam action yet it is hardly visible in the holder.

The application of the spring loaded holder 30 of the present invention is not limited to picture frames or holding sheet materials. Any three dimensional object can be held by this holder as long as the angle of contact of the holder plate is within the activated zone seen in FIG. 3A.

More than one holder can be placed around an object for holding this object. The support base to each holder can be individually adjusted in both its position and angle to maximize each holder's holding power. The resultant system will be so versatile in holding objects of any size or shape.

For the present discussion, a spring loaded holder is defined as a holder which has one or more springs from which the holder is enabled to hold a stack of sheets of various thickness or an object of various shape. Here the term "stack of sheets of various thickness" refers to one stack comprising various number of sheets starting from just one sheet.

The holder 30, as well as the holders 120, 178, 202, 262, and 272 to be described later, are a special kind of spring loaded holders. In each of these holders one or more springs are imbedded as part of a cam assembly from which a cam action is derived for enabling the holding function of the holders. So these holders can also be termed as cam assembly based holders.

Figure 4:
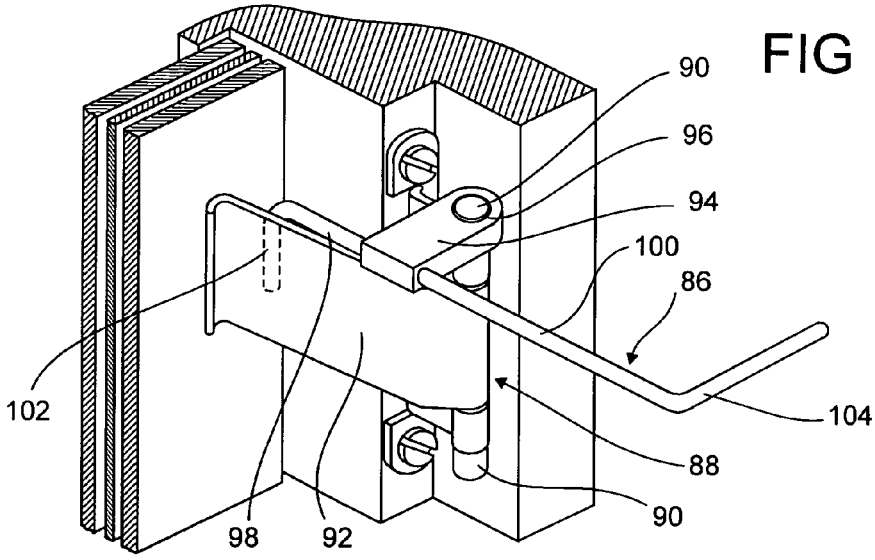
FIG. 4 shows the perspective view of a holder plate lifter, as it is mounted on the holder of FIG. 1, for rotating the holder plate away from a closed position.

FIG. 4 shows a holder plate lifter 86 which can be used to lift open the holder plate when needed. In most cases the holder plate can be lifted by using a finger to pry it open. But for certain large and strong holders the use of this holder plate lifter 86 can certainly make the job easier.

The holder 88 shown in FIG. 4 is largely copied from the holder 30 shown in FIG. 1. The only change made here is to make the two pin heads 90 thicker to facilitate the engagement of the holder plate lifter 86.

The holder plate lifter 86 is preferably made from a molded plastics. It has a center plate 94 with an opening 96 engageable with the pin head 90 of the holder 88. There are two co-linear rod members 98 and 100 projecting outward, and opposite to each other, from the center plate 94. The end of the rod member 98 is bent downward forming an elbow 102. The rod member 100 is also bent, but horizontally to the right, forming an elbow 104.

The operation of this holder plate lifter 86 is very simple. Just mount the center plate 94 on the pin head 90 while inserting the elbow 102 into the back side of the holder plate 92 as shown in FIG. 4. Grab the elbow 104 and rotate it to the right until the holder plate is rotated into the deactivated zone. This is indicated by the sudden disappearance of the resisting force. Now the holder plate lifter 86 can be removed from the holder 88. The holder plate 92 can be further rotated if necessary until the frame body is clear for the removal of the art sheet assembly.

FIG. 5

FIG. 5 shows a second preferred embodiment of the spring loaded holder of the present invention. The holder 120 shown in this figure is of different structure than that of the holder 30 shown in FIGS. 1–4 but performs the same function described above.

Just as the holder 30 shown in FIGS. 1–4 and described above, the holder 120 also comprises a stationary holder base 122, a rotatable holder plate 124, a cam assembly 126 which includes a plunger 128 and two compression springs 130, and two pins 132. The compression springs 130 are not shown in FIG. 5, but can be similar to the compression springs 50 shown in FIG. 2 and described above.

The difference between the holder 120 and the holder 30 mainly resides on the construction of the stationary holder base 122, and the rotatable holder plate 124, and the placement of the cam assembly 126. First, the stationary holder base 122 has a curl or sleeve 134. A cut out 136 with rounded edge is formed on this curl 134. This curl 134 and the cut out 136 are similar to the curl 62 and the cut out 64 in the holder plate 44, respectively. But there is a difference. The curl 62 and the cut out 64 are rotatable with the holder plate 44, while the curl 134 and the cut out 136 are part of the stationary holder base 122 and are not rotatable.

As shown in FIG. 5, the rotatable holder plate 124 has a pair of outer curls or sleeves 137 hinged on and rotatable with respect to the pins 132. This holder plate 124 also has a center flange 138 whose end is bent to form a right angle bent 140. Both the center flange 138 and the right angle bent 140 are rotatable with respect to the pins 132. Housed within the center flange 138 and the right angle bent 140 is the cam assembly 126 which is also rotatable along with the holder plate 124.

As the cam assembly 126 is rotated into contact with the cut out rounded edge 136 on the curl 134 a cam action is initiated. The created torque from this cam action will cause the holder plate 124 to further rotate until it is stopped by the picture frame or the mounted sheet stack.

It is clear from the above description that in spite of the different structure, the holder 120 will achieve the same cam action when mounted on a picture frame just like the holder 30. The main reason when the holder 120 is chosen over the holder 30 is in the cost of production.

FIG. 6

FIG. 6 illustrates the great benefit the standardization on the sizes of the picture frames, mat boards, and the art sheets will bring to the business of selling framed arts employing the art frames of the present invention. Instead of custom making an art frame to fit an given art sheet of unique size, the present approach will standardize all art sheets so each of which will fit in at least one art frame of standard size.

Shown in FIG. 6 is an art frame 142 of the present invention. It includes a frame body, a frame glass and a rigid backing plate. It has an internal size among several standard sizes available. Here the term "internal size" refers to the length and width inside the frame and not to its depth or thickness. Four spring loaded holders of the present invention are installed in this art frame 142. It can firmly hold any number of art sheets/mat boards with total thickness of 0.5" (1.27 cm) or less.

Also shown in FIG. 6 are three art sheets 143, 144, and 145 in a Claude Monet art series. Two mat boards 146 and 147 form a double mat for the display of the Monet art sheets 143, 144, and 145. It is noted that the art sheets 143, 144, 145 as well as the two mat boards 146 and 147 all have the same overall size designed to fit in the art frame 142. The picture portion of each of the three art sheets 143, 144, and 145 can be nicely displayed through the opening of the mat board 146. All these are achieved by size adjustment of all art sheets as part of the art sheets size standardization process.

The art sheet size standardization basically means that in a reproduction of the original art the overall size of the reproduced art sheet is changed or made to be the same as the internal size of one standard art frame. There is no hard rule on how to change the size of the art picture portion itself in the reproduction process. If no mat board is needed in the final framed art the entire art sheet can be printed with the art picture. With the presence of the mat boards as seen in FIG. 6 it is preferred, but not necessary so, that the art picture portion be made smaller so no significant portion of the art picture gets blanked out by the mat board.

The beauty of the art sheet size standardization is that custom framing is no longer required. The owner of the newly acquired art sheet with size standardization can simply choose one available standard art frame with preferred style to frame this art sheet. If the owner already has an existing reusable standard art frame he can choose to purchase the art sheet he wants in size matching his existing art frame so no new frame has to be purchased.

In the present invention it is proposed that an art frame capable of firmly holding any number of art sheets/mat boards with total thickness of 0.5" (1.27 cm) or less, and a plurality of individual and separate art sheets, with its overall size standardized to be the same as that of the internal size of the art frame, be sellable in one business transaction or one pseudo business transaction as one ensemble. The fact that more than one art sheets to be sold along with an art frame equipped with the novel spring loaded holding means as one ensemble, preferably packed and priced together but not necessary so, will offer buyer an immediate opportunity to practice and appreciate the display change feature provided by the art frame of the present invention. The multiple art sheets with size standardization and an art frame with spring loaded holding means are put together to create a synergetic benefit in the mind of consumer and will undoubtedly be a strong incentive and improve the sale of this ensemble. This novel ensemble concept will be beneficial even when some art frames with other spring loaded holding means should appear in the future.

As mentioned above, all contents of the present ensemble need not be packed together as one unit. A buyer may purchase an art frame and mat boards of standard size in one business transaction, but with this purchase the buyer is entitled to choose up to three matching art sheets at a later time free of charge. An art frame and one matching art sheet may be purchased first in one business transaction, but with this purchase the buyer may get one additional art sheet free of charge or at a discount at a later time. All these cases and other similar situations in which the subsequent business transaction is still related to the initial business transaction are herein referred to as one pseudo business transaction. The common result is that at the end of this pseudo business transaction the buyer will get the ensemble including an art frame with the novel spring loaded holding means and a plurality of art sheets with standardized size matching the art frame. One or more mat boards of the same overall standard size may also be optionally included in this ensemble. This will allow the buyer an immediate opportunity to practice and appreciate the display change feature of the art frame just like the case in which all components of the ensemble are acquired in one business transaction.

In spite of what discussed above, it is still preferred that the ensemble including an art frame capable of firmly holding any number of art sheets/mat boards with total thickness of 0.5" (1.27 cm) or less, one or more mat boards if needed, aid a plurality of individual and separate art sheets with its overall size standardized to be the same as that of the mat boards and the internal size of the art frame, to be packed together in one unit and sellable in one business transaction. This is the most straight forward sales approach which will greatly benefit both the sellers and the buyers.

The art sheets 143, 144 and 145 are part of twelve art sheets Claude Monet art series. All twelve art sheets are of the same standard size. The user can continue purchase the other art sheets by them self and display and store them in the existing art frame 142 using the same mat boards 146 and 147. Of course the user can also purchase other art sheets of the same standard size but painted by other artists and display and store them in the same art frame 142.

The twelve art sheets by Monet can also be grouped into four ensembles each one including one art frame 142, two mat boards 146, 147, and three art sheets. Each ensemble can be sold in a single business transaction. This is desirable if the user wants to display two or more Monet's art sheets simultaneously.

FIGS. 7–8

FIGS. 7 and 8 disclose a novel picture frame of the present invention, which when installed with the spring loaded holders as shown in FIGS. 1–5 and described above, can be employed for a new application of displaying and storing expired calendar books.

FIG. 7 shows, among others, two expired calendar books 160 and 162. Each calendar book is a commonly seen monthly calendar having seven or more sheets stapled together or by other means along an imaginary dividing or center line 164. Most of these sheets are printed on each side one calendar picture and one calendar date table. Once the calendar book is turned from one page to the next page a new calendar picture is seen on the top half of the calendar and a new monthly calendar date table is seen on the bottom half of the calendar.

Also seen in FIG. 7 are two mat boards 166 and 168. These two mat boards are of same outside dimension but of different opening sizes. The mat board 166 is suitable for displaying the calendar book 162 while the mat board 168 is suitable for displaying the calendar book 160. For displaying one calendar picture, from say the calendar book 160, it is simply done by turning the page until the desired calendar picture is exposed. This calendar book 160 is then folded backward along the center line 164 and placed behind the mat board 168 with the picture side facing the mat board.

A picture frame 170 of the present invention will now be employed for displaying the calendar book 160 and storing the calendar book 162. As seen in FIG. 7, this picture frame comprises a frame body 172, a frame glass 174, and a rigid backing plate 176. The calendar book 160 is placed immediately behind the mat board 168 and the frame glass 174. The backing plate 176 will always be placed immediately behind the calendar book to be displayed. All mat boards to be stored in the picture frame 170 are placed next to the backing plate 176. All calendar books to be stored are folded and placed behind the stored mat boards.

FIGS. 8*a* and 8*b* show the front elevational view and back elevational view, respectively, of the assembled picture frame 170. In FIG. 8*b* the first item to be noticed are the four spring loaded holders 178. Each holder 178 is similar to the holder 30 shown in FIGS. 1–4. It is shown in FIG. 8*b* that two holders 178 are installed on the top side of the frame body 172 and two holders 178 are installed on the bottom side of the frame body 172. Depending on the shape of the frame body in some picture frames it is more preferable that these two pairs of holders be installed on the left and right sides of the frame body.

Obviously all holder plates of the holders 178 must first be opened to the deactivated position near the position similar to the first extreme position 44' as shown in FIG. 3A in order to clear the picture frame 170 for the entry of all calendar books and mat boards. Preferably with the frame body 172 resting on a table with its back facing up, all the items including the frame glass 174, mat board 168, calendar book 160, backing plate 176, mat board 166 and the calendar book 162, in that order, can now be placed in the frame body 172. Obviously, the calendar book 160 needs to be centered in order to be properly displayed through the opening of the mat board 168 as shown in FIG. 8*a*.

It is important that except for the calendar book 160 each of the items above mentioned must be placed in the frame body 172 with its bottom edge touching the bottom inside wall of the frame body 172. This is to assure that once the picture frame 170 is vertically hung on a wall all the weight of the mounted items except the calendar 160 are supported by the bottom inside wall of the frame body 172. No shifting of the so mounted items will occur after the assembled picture frame 170 is vertically displayed.

After all items are loaded in the frame body 172 the four holders 178 can be rotated away from their open positions. Once these holder plates of the holders 178 enter into the activated zone the cam action will be initiated and apply a torque to each holder plate and automatically rotate it to its closed position. The holding force exerted by these holder plates will be continuously applied to all mounted sheets and hold them in their mounted positions. This holding force will also firmly suspend the calendar book 160 properly behind the mat board 168 indefinitely as shown in FIG. 8*a* without adhesive tape.

It is noted that the contact surface of each holder plate of the holder 178 when in the closed position projects deep into frame and away from the frame inside wall. As a general rule this contact surface should be at least 0.5" (1.27 cm) and preferably at least 1" (2.54 cm) away from the frame inside wall. This minimum distance will assure that the holder contacting point be very close to the suspended calendar book 160. The applied holding force will be more effectively applied to the calendar book 160 and prevent it from shifting during the vertical wall display.

It is also interesting to note in FIG. 8*b* that the calendar book 162, due to its small size in comparison with the picture frame 170, is only held by the two lower holders 178. This is acceptable since the calendar book 162 is only to be stored in the picture frame 170. The fact that the contacting point of the holder is at least one inch away from the frame inside wall makes the two lower holders 178 to act as two effective "book ends" for holding the calendar book 162 without falling.

A second rigid backing plate 179 can also be optionally provided as part of the present picture frame 170. This backing plate 179 is seen in FIG. 8*b* mounted behind the stored calendar book 162. It has a width same as that of the backing plate 176 but is shorter so that it is only to be held by the two lower holders 178. Because of its rigidity this backing plate 179 will hold the stored calendar 162 upright and prevent it from bending backward during storage.

As more and more unused calendar books are stored in the picture frame 170 the holding force of the two lower holders 178 will be getting weaker and weaker. As a general rule the total stack of the mounted calendars and associate plates should not exceed 70% of the total frame capacity. It should also be noted that in spite of the weaker holding force of the two lower holders 178 due to increased number of stored calendar books, the two upper holders 178 are not affected and will still provide adequate holding force for holding the suspended calendar book 160.

A more in depth discussion on the function of the holders 178 for displaying and storing expired calendar books will now be provided. The primary function of the holders 178 is to hold the displayed calendar book in suspension. The holding force exerted by the cam action will create friction between the calendar book and the adjacent sheets against shifting of the displayed calendar book during normal wall display.

As mentioned above, all sheets except the suspended calendar book should rest on the bottom inside frame wall during its wall display. Under this condition the secondary function of the holders 178 is to press all installed sheets in one stack during its wall display and frame handling. The holders 178 of the present invention used for displaying and storing expired calendar books will have enough holding power for the primary and secondary functions above described.

For safe handling, it is recommended that the picture frame is always kept up right without excessive shaking. If the picture frame must be laid flat it should be positioned faced down. One may ask what would happen if the loaded picture frame is accidentally placed face side up. Obviously, it is not a problem if the loaded sheets is not full and can be held in place by the holders. If the loaded sheets are excessive and beyond the holding capacity of the holders for this faced up position, usually the two lower holders will yield which will cause the calendar stack to partially sag inside the frame. The calendar book to be displayed is more likely shifted out of position. The picture frame will need to be opened and all loaded sheets to be repositioned.

The third function of the holders, if desired, is to provide the cam action of the holders strong enough so that it can hold the entire weight of all installed calendar stack up to a specified loading limit, says, 40% full load. This means that the entire weight of all installed sheet stack up to this loading limit can be held by the holders without shifting or collapsing if the loaded frame is placed face side up. But more calendar books can be stored without shifting by not supporting their dead weight if the up side down and face side up positions can be avoided.

The above description on the functions of the holders for displaying and storing expired calendar books is also applicable for displaying and storing individual art sheets. Because of its lighter weight compared with the expired calendar book the task of holding an art sheet in suspension behind a mat board can be achieved much easier. The loading order of all art sheets to be stored can also follow what was described above as shown in FIG. 8*b*. All smaller art sheets to be held by only two lower holders should be placed on the back of all other art sheet stack. The second backing plate 179 should also be used to prevent these small art sheets from bending during the wall hanging of the frame.

As shown in FIG. 8*b*, a back board 180 can also be optionally provided as a back cover to the picture frame 170. A frame peripheral 182 and a plurality of turn buttons 184 are provided for removably mounting this back board 180. This back board 180, once mounted as shown in FIG. 8*b*, will limit the accidental movement of the holder plates. It will also keep all mounted art sheets safely inside the picture frame in case it is shaken loose due to heavy handling. Two hangers 186 can also be provided to hang the picture frame on a wall.

FIGS. 9–12

FIGS. 9–12 discloses a third embodiment of the spring loaded holder of the present invention. This type of holder is mainly applied to various kind of holding boards for holding sheet materials. It may include fun boards, bulletin boards, and poster boards. Special attentions are paid for ease of operation and safety mainly applicable to young users.

Figure 9:
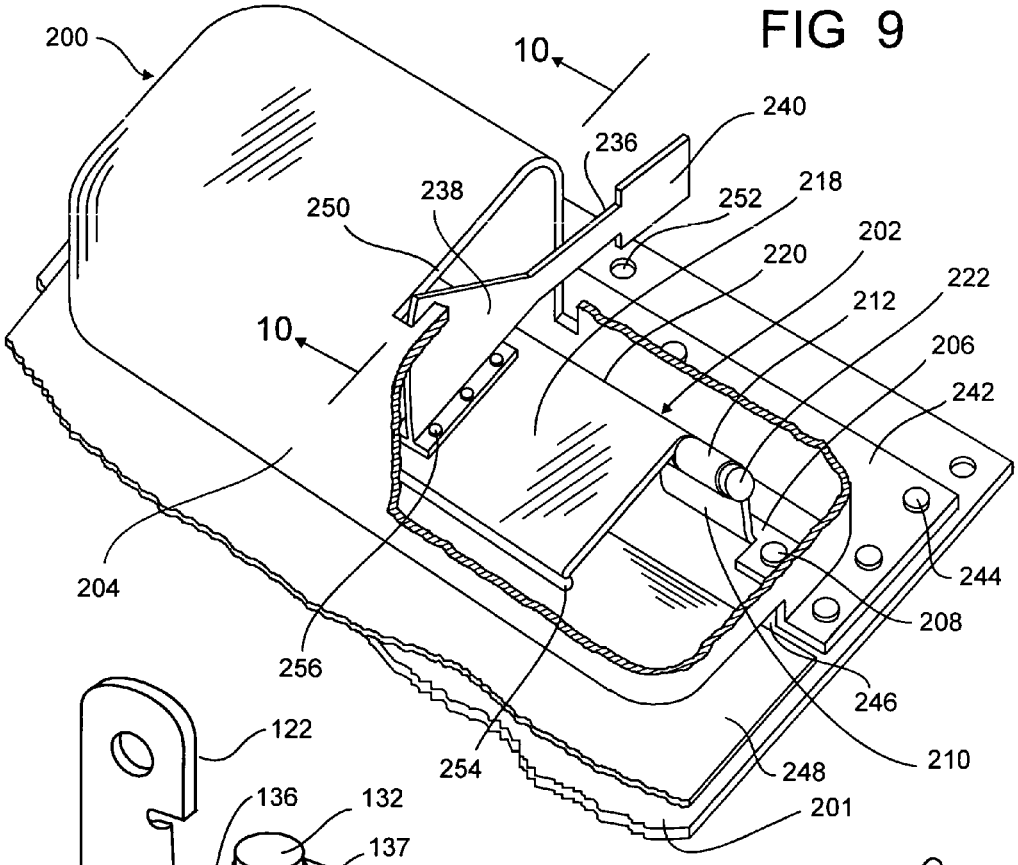
FIG. 9 is a perspective view of (1) a third embodiment of the holder of the present invention, (2) a cover with a portion broken off to show the internal details, (3) a board on which the holder and the cover are installed, and (4) an art sheet to be held by the holder.

Shown in FIG. 9 is a fun board 200 which offers several advantages over the conventional clipboards. It comprises a board 201 and a holder 202 mounted on the board 201. It also comprises a cover 204 covering the holder 202. A portion of this cover 204 is removed to reveal the details of the holder 202.

The board 201 is typically made of molded plastics. The holder 202 is in many way similar to the holder 30 shown in FIG. 1. It comprises a stationary holder base 206 which is mounted on the board 201 by rivets 208 or other suitable means. Similar to the stationary holder base 42 shown in FIG. 2, this stationary holder base 206 also comprises two side flanges 210 with two curls 212 on its ends, and a center flange 214 with a right angle bent 216. The second component of the holder 202 is a rotatable holder plate 218 with a curl 220. Two pins 222 are inserted into the curls 212 and curl 220 to rotatably mount the holder plate 218 on the stationary holder base 206.

One major difference between the holder 202 and the holder 30 is the width of the holder plate 218 which is much wider in relation to the size of the holder 202. This wider holder plate will allow for a wider contact between the holder plate 218 and the art sheet 248 to be held on the board 201.

The front end of the holder plate 218 is curved downward and is covered by a layer of rubbery material 254 to facilitate the gripping of the art sheet 248 to be held by the holder plate 218. This rubbery material 254 will also reduce the bang sound on the closing of the holder plate 218.

One other component of the holder 202 is a cam assembly 224 which includes a plunger 226 and a plurality of compression springs 228. In view of the wider holder plate 218 the plunger 226 will also be wider. It is suggested that a total of four plunger wells 230 be provided on the plunger 226 for holding four compression springs 228 within the space between the side flanges 210 and the center flange 214 of the stationary holder base 206. Two grooves 232 on the plunger 226 accompanied by two bumps 234 on the right angle bent 216 will guide the reciprocal motion of the plunger 226.

To facilitate the manual rotation of the holder plate 218 a leverage plate 236 can be mounted on the holder plate 218 using rivets 256 or other suitable fastening means. This leverage plate 236 is positioned at right angle to the holder plate 218. The front portion of this leverage plate 236 has a shape similar to and thus termed as a shark's fin 238. The back portion of this leverage plate 236 can be similarly termed as a shark's tail 240. To heighten the interest of the rotation of the holder plate 218 the shark's fin 238 is made in red color to signify danger while the shark's tail 240 is made in green color to signify safety. This is the reason from which the name fun board is derived.

The cover 204 is a molded plastic largely of rectangular shape. There is a flange 242 integrally joined to the back portion of the cover for mounting the cover 204 to the board 201 using rivets 244 or other fastening means. The front portion of the cover 204 has a clearance 246 of about 0.25" (0.64 cm) allowing entry of art sheets. The art sheet 248 is shown inserted into this clearance 246. This clearance restriction virtually will prevent any user's finger from accidentally getting caught by the holder plate 218. This safety feature is especially beneficial to younger users.

As seen in FIG. 9 almost the entire holder 202 is covered under the cover 204. The only exception is a slot opening 250 located on the top and back walls of the cover 204. This slot opening 250 allows user's access to the shark's tail 240. The shark's fin 238 can also be accessed when the holder plate 218 is in the open position.

Figure 10A:
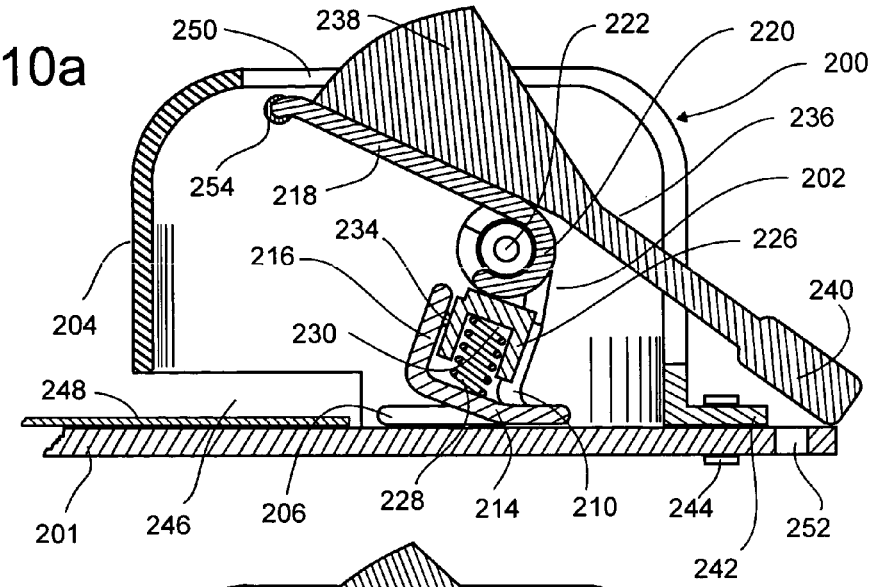
FIG. 10 are sectional views of the holder of FIG. 9, taken substantially on a vertical plane containing the line 10—10, as the holder plate is rotated to three different positions.
Figure 10B:
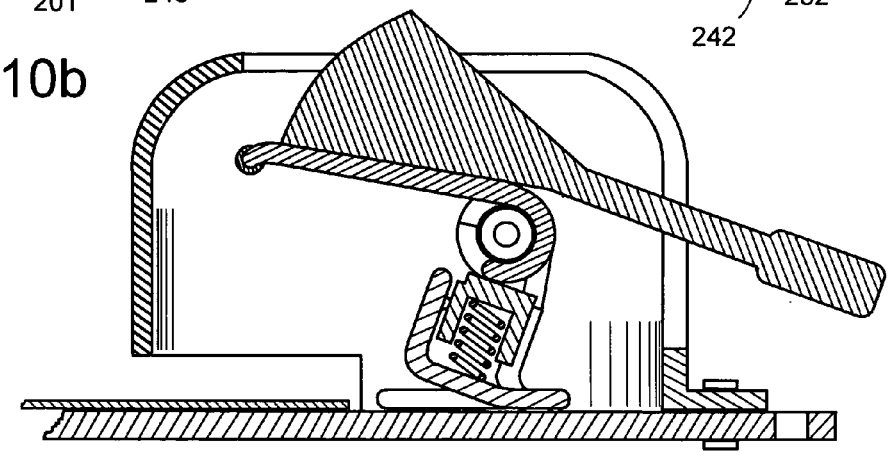
Figure 10C:
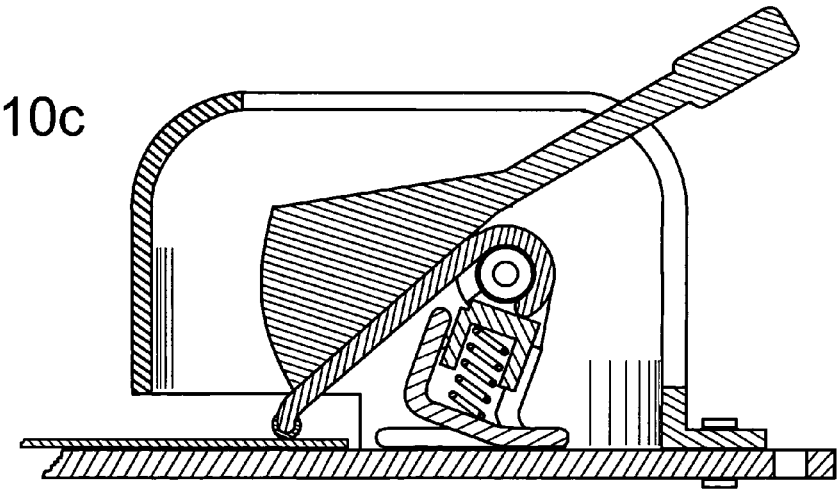

FIG. 10 shows the details of the operation of the holder 202. FIG. 10*a* is when this holder plate 218 is rotated to a deactivated zone. FIG. 10*c* is when the holder plate 218 is rotated to an activated zone. FIG. 10*b* is when it is at a critical position between the activated zone and the deactivated zone.

When the holder plate 218 is rotated to the position indicated by FIG. 10*a* the shark's fin 238 becomes visible outside the slot opening 250. This signifies "danger" because the art sheet 248 inserted into the clearance 246 underneath the cover 204 is not secured. The shark's fin 238 needs to be pushed into the slot opening 250 to wipe out this "danger". As the shark's fin 238 is pushed beyond the position indicated by FIG. 10*b* the user is pleasantly jolted to observe the shark's fin 238 suddenly disappear from underneath her finger. At the same time the green shark's tail 240 emerges from the slot opening 250. This signifies "safety" as the art sheet 248 is now safely secured as indicated by the position of the holder plate 218 shown in FIG. 10*c*.

To change the art sheet display one can simply push down the shark's tail 240 from its initial position at FIG. 10*c* until the shark's tail 240 is stopped by the board 201 as seen in FIG. 10*a*. The holder plate 218 will stay at this position indefinitely. This will allow ample time for the user to remove the existing art sheets, resort the new art sheets to be inserted, insert the new art sheets, reposition the stack to make it neat in appearance. Only when everything is to the user's satisfaction the shark's fin 238 can then be pushed down to hold tight the new art sheet stack.

The above described operation of the holder 202 is more desirable than the conventional clipboards which require user to hold the clip against its spring continuously in the open position by one hand while doing the display change by the other hand. For more extensive display change one may have to perform the clipboard open-close cycle several times to get it right. Such display change is even harder to perform while the clipboard is hanging on a wall.

It is interesting to note that the present holder 202 also allows the user to operate the fun board 200 as a conventional clipboard. In this operation the shark's tail 240 is only pushed down slightly before it reaches the position in FIG. 10*b*. The shark's tail 240 is then held in that position with one hand while doing the display change with the other hand. After completion of the display change the hand holding the shark's tail 240 is released. The shark's tail 240 will automatically jump back to the top position as in FIG. 10*c* which returns the holder 202 to the holding position. Such operation is recommended only when an empty fun board is to be inserted with only one sheet.

The use of the leverage plate 236, in addition to being fun, also greatly facilitates the operation of the holder 202. Instead of pulling up the holder plate 218 each time to open the holder 202, one simply pushes down the shark's tail 240. The long arm of the shark's tail 240 also creates the benefit of this leveraged operation.

It should be pointed out that the fun board 200 of the present invention can also be used as a wall mounted board for displaying a photo or picture sheet. Three hanging holes 252 are provided for hanging this fun board using its center or two upper corner holes 252. FIGS. 11 and 12 demonstrate several way for displaying a picture on a wall mounted board which is also applicable for the present fun board 200.

It is interesting to compare the operations of the holder 202 as seen in FIG. 10 and the holder 30 as seen in FIG. 3. In FIG. 3, the art sheets to be held by the holder 30 are always positioned below the stationary holder base 42. A longer rotatable holder plate 44 is usually required. It is just a matter of designing the depth of the inside frame wall to match the length of the holder plate to gain the maximum or near maximum torque offered by the holder 30 as indicated by the FIG. 3C position.

In FIG. 10, the art sheets to be held by the holder 202 are always near or above the stationary holder base 206. The length of the rotatable holder plate 218 is usually shorter. Due to this physical limitation the maximum or near maximum torque offered by the holder would be difficult to realize.

In order to realize the maximum or near maximum torque offered by the holder, the design of the holder 202 as shown in FIG. 10 embodies a major change over the basic holder 30. Instead of using a holder with an upright stationary holder base, a part of the stationary holder base 206 including the side flanges 210, the center flange 214 and the right angle bent 216 are tilted about 20 degree clockwise. Since the cam assembly 224 including the plunger 226 and the compression springs 228 is held and guided by the stationary holder base 206, the plunger 226 will also maintain a reciprocal motion along a direction tilted by 20 degree clockwise.

FIG. 10*c* shows that the torque achieved with the holder 202 in the present fun board 200 is about the same as the torque resulted from the holder 30 used in the picture frame 32 with the holder plate 44 resting at the FIG. 3C position. Since the fun board 200 is designed for holding art sheets no more than 0.25" (0.64 cm) thick, the present fun board 200 is always operated at the maximum or near maximum torque inherent to the holder 202.

FIG. 11 shows a bulletin board 260 of the present invention. This bulletin board is here defined as a wall mounted board simultaneously and independently displaying a plurality of sheet stacks each of which is held by a cam assembly based holder of the present invention. Such bulletin board should allow all sheet stacks to be mounted on or removed from the board either with or without taking the bulletin board down from the wall.

In FIG. 11 two holders 262 are shown installed on a board 264 side by side. Each holder 262 is similar to the holder 202 above described as shown in FIGS. 9–10. Each holder 262 can be used to hold and display a stack of sheets independent from the other holder 262. One most desirable bulletin board may be one with a board 264 which is large enough to hold two stacks of sheets of letter (8.5"×11", 21.6 cm×27.9 cm) or A4 (21 cm×29.7 cm, 8.27"×11.69") size which are most commonly used standard sheet formats. Of course bulletin boards with different number of holders, for holding different sizes of sheet stacks, and arranged in different patterns can all be devised with ease.

Three hanging holes 266 are provided on the board 264 for hanging the bulletin board 260 on a wall. To change the display of any sheet stack the user simply holds the sheet stack to be replaced or the empty board if there is no sheet on display by one hand while opening the holder plate by the other hand. The holder 262 will stay at this open position indefinitely. This will allow ample time for the user to remove the existing sheets, resort the new sheets to be inserted, insert the new sheets, reposition the stack to make it neat in appearance. Only when everything is to the user's satisfaction the holder 262 can then be closed to hold tight and display the new sheet stack.

As shown in FIG. 11, the bulletin board 260 of the present invention can also be used for holding picture sheets or photos. A clear and soft pocket 268 made of vinyl or other transparent materials is shown holding a Mona Lisa print 269 and can be readily held by the holder 262. The pocket opening is preferably placed inside to prevent dust getting into the pocket. A sheet with multiple pocket openings can also be held for displaying photos of similar size.

In summary, the bulletin board of the present invention provides many advantages over the conventional bulletin boards. First of all, it allows easy mounting and removal of sheets to be displayed either with or without removing the bulletin board from the wall. No pins or glue are needed for holding the displayed sheets. Yet the sheets will be held more securely than the use of pins or glue. Multiple sheets in a stack can be held and flipped for checking the posted information. The display is more organized and neat in appearance. Photos and pictures can also be easily displayed using transparent pockets. Finally, the present bulletin board is pleasing to look at and fun to operate.

FIG. 12 shows a poster board 270 of the present invention. This poster board is here defined as a wall mounted board for mounting and displaying a sheet stack such as a large poster on the board using two or more cam assembly based holders of the present invention. Such poster board should allow all sheets to be mounted on or removed from the board either with or without taking the bulletin board down from the wall.

In FIG. 12 two holders 272 are shown installed on a board 274 side by side. Each holder 272 is similar to the holder 202 above described as shown in FIGS. 9–10. It is important that these two holders be positioned at the same height or level. This is required for holding a rectilinear poster sheet. Of course poster board with more than two holders can also be devised for holding and displaying large architecture or engineering drawing with ease.

Three hanging holes 276 are provided on the board 274 for hanging the poster board 270 on a wall. To change the display of the existing poster sheet the user simply holds the poster sheet to be replaced by one hand while opening one holder 272 by the other hand. The user next proceeds to open the other holder 272. After both holders 272 are opened the existing poster sheet can then be removed. The user will have ample time to insert the new poster sheet to be displayed in both holders 272, carefully re-center the new poster in the poster board 270. Only when everything is to the user's satisfaction the two holders 272 can then be closed one after the other for holding and displaying the new poster sheet.

The above described operation reveals an important fact in the use of two or more holders of the present invention for mounting or removing a large sheet. Because each holder can be opened and stays open and can be closed and stay closed, two or more holders can be operated in sequence to achieve the job of mounting or removing a large poster sheet. This is simply impossible if two or more conventional clips are to be used in sequence as a one man operation.

FIG. 12 also shows a simple and elegant way to protect a displayed large poster picture. In the poster board 270 a Mona Lisa poster 278 and a transparent and soft sheet 280 made of vinyl or other suitable transparent materials are both held under the two holders 272. The transparent sheet 280 is slightly larger than the Mona Lisa poster 278 and serves as a protective shield to the displayed Mona Lisa poster 278. The surface of the board 274 is made very smooth which allows the portion of the vinyl sheet 280 outside the Mona Lisa poster 278 to cling onto the board 274 and form an excellent seal to the displayed poster 278.

One unique feature of the poster board 270 is that there is no limit to the size of the poster sheet that can be mounted on this poster board 270. The width or height of the mounted poster sheet can extend beyond the board 274 if necessary. On the other hand, two smaller sheets can also be separately mounted one by each holder 272. This will turns the poster board 270 into a bulletin board just like the bulletin board 260 shown in FIG. 11.

FIG. 13

FIG. 13 shows another spring loaded holder which can be used in an art frame of standard internal size for holding a plurality of art sheets each of which has an overall size standardized to be the same as the internal size of said art frame.

Shown in FIG. 13 is a back loading art frame 300 which comprises a frame body 302, a frame glass 304 and a rigid backing plate 306. The frame body 302 has a standard internal size same as the overall size of the three Monet art sheets 143, 144 and 145 and the two mat boards 146 and 147 previously described and shown in FIG. 6, and now reproduced in FIG. 13.

Installed on the back of the frame body 302 is a frame peripheral 308. A plurality of turn buttons 310 are mounted on the frame peripheral 308. Also mounted on the peripheral 308 are two hangers 312 for hanging the art frame 300 either vertically or horizontally on a wall.

Also shown in FIG. 13 and as part of the art frame 300 is a back board 318 and a spring loaded holder 320 fastened to the back board 318 by rivets 322 or other fastening means. The spring loaded holder 320 is a single piece preferably made by injection molding using elastic plastic such as polycarbonate. It basically comprises a base plate 324 and four compression leaf springs 326 projecting above and away from the base plate 324 as seen in the figure.

Once the frame glass 304, mat boards 146 and 147, art sheets 145, 143 and 144, backing plate 306, in that order, are mounted inside the frame body 302, the frame body 302 can be closed by placing the back board 318 over the back side of the frame body 302. This is followed by rotating all the turn buttons 310 to hold the back board 318 in place.

As the back board 318 is closed and held by the turn buttons 310, the tips of all four leaf springs 326 will be pressed on the backing plate 306. The spring force exerted by the leaf springs 326 will allow the entire art sheets and associated sheets in one compact stack and allow the art sheet 145 to be properly displayed in the art frame 300.

It is just a matter of designing the depth of the frame body 302 and the flexing property of the leaf springs 326 to come up with an art frame capable of firmly holding any number of art sheets with total thickness of 0.5" (1.27 cm) or less. In the present invention it can therefore be proposed that an art frame equipped with an spring loaded holding means such as the spring loaded holder 320, and a plurality of art sheets, with its overall size standardized to be the same as the internal size of the art frame, can be packed together and sellable in one business transaction, or if not packed together, be sellable in one business transaction or one pseudo business transaction as one ensemble.

This novel one ensemble selling concept, as first proposed in the earlier discussion in connection with FIG. 6, is now again possible with the art frame 300 in FIG. 13. The multiple art sheets with size standardization and an art frame with spring loaded holding means, such as the spring loaded holder 30 shown in FIGS. 1–4 or the spring loaded holder 320 shown in FIG. 13, are put together to create a synergetic benefit and offer buyer an immediate opportunity to practice and appreciate the display change feature of this ensemble.

Unlike the spring loaded holder 30, the spring loaded holder 320 is a plastic spring and will not have enough spring power to hold an art sheet, smaller than the art frame internal size, in suspension. But this short fall will not affect the present one ensemble application since all art sheets to be displayed are all size standardized and will not be suspended in the art frame.

The spring loaded holder 320 by itself is not a new invention since similar spring loaded holder has been disclosed in one prior U.S. Pat. No. 6,293,038. In this prior art (FIG. 31) a spring plate with eight compression leaf springs is employed for holding a plurality of loose calendar sheets in a stack, but not for supporting the weight of the calendar sheet in display. These calendar sheets, which can also be considered as art sheets, have special step design and slot holes for supporting the weight of each calendar sheet and do not have standardized size same as the internal size of the frame displaying the calendar sheet.

FIG. 14

In this section, a new kind of picture frame with a new spring loaded holding means will be described which can be used in lieu of the picture frame 170 shown in FIGS. 7–8 and discussed above for displaying an expired calendar book and storing a plurality of calendar books.

Shown in FIG. 14 is a picture frame 340 which comprises a frame body 342. Mounted inside the frame body 342 are the frame glass 174, mat board 168, expired calendar book 160, rigid backing plate 176, mat board 166 and the expired calendar book 162, in that order, all of which have been described before and shown in FIG. 7.

The frame body 342 has an internal size same as the internal size of the frame body 172 and the size of the mat boards 166 and 168. A peripheral 344 is installed on the back of the frame body 342. A plurality of turn buttons 346 are mounted on the peripheral 344. These turn buttons are formed by plastic injection molding. Each turn button 346 is reinforced by ridges on its edge to withstand large pressing force without bending as will be further discussed below. Two hangers 348 are provided for hanging the picture frame 340 either vertically or horizontally on a wall.

As shown in FIG. 14, the picture frame 340 also comprises a strong rigid back board 350 and a spring loaded holder 352 mounted on the back board 350 by four rivets 354 or similar fastening means. It is preferably made of spring steel sheet for its strong spring force.

The spring loaded holder 352 mainly comprises a spring base 356 and four compression leaf springs 358 projecting out and away from the spring base 356. This holder 352 is structurally similar to the spring loaded holder 320 shown in FIG. 13. The main difference is the spring steel material used in the holder 352 with stronger holding power which is needed for holding the displayed calendar book 160 in suspension in the picture frame 300.

To start the frame loading process the frame body 342 is first placed face down on a table. The calendar book 160 and 162 and other associated sheets as shown in FIG. 14 are then placed face down in the frame body 342. Make sure the bottom of the calendar book 162 and other sheets are in contact with the inside bottom frame wall so they will all be supported by the bottom frame wall once the frame 340 is hung on a wall. The calendar book 160 will be folded back to expose the calendar picture to be displayed. It must be properly centered in reference to the mat board 168.

The frame body 342 can now be closed by placing the back board 350 to its back. As the back board 350 is closed down the four leaf springs 358 will be pushed back which will exert a strong spring force on the stored calendar book 162 and all sheets in its front. This strong spring force will also maintain the folded back calendar book 160 properly suspended and displayed through the mat board 168.

As the back board 350 is completely closed all turn buttons 346 can now be rotated to hold the back board 350 in place. At this time the back board 350 is continuously experiencing the pressing force exerted by the distorted leaf springs 358. This pressing force will also be transmitted to all turn buttons 346. Since these turn buttons 346 are strengthen by its ridge reinforcement they will not be easily bent.

A brief discussion on the use of leaf spring holders in general, including both the leaf spring holders 320 and 352, will now be given. The force for holding a stack of art sheets in a picture frame is produced when the leaf springs are pushed back, distorted, or displaced as they are in contact with the art sheet stack. The strength of this holding force is directly proportional to the degree of this spring displacement. This means that the holding force is always the largest when the frame has a full load of art sheet stack, and weakest when the frame has a minimum load of art sheet stack. This is in sharp contrast with the spring loaded holder 30 shown in FIGS. 1–4 in which the holding force is strongest when there is a minimum load of art sheet stack and is weakest when there is a full load of art sheet stack.

For a picture frame started out with minimum load of art sheet stack the use of leaf spring type of holder may not have enough holding power. This is usually not a problem if the leaf spring holder is only needed for maintaining a tight sheet stack and is not needed for holding an art sheet or calendar book in suspension.

There is a way if one wishes the picture frame with a leaf spring holder to always work at the maximum or near maximum holding power regardless the load of the art sheet stack. This can be achieved by placing spacer sheet(s) of different thickness behind the art sheet stack so the leaf spring are always maintained at the maximum displacement. Although it is doable, it does cause some inconvenience of carrying spacer(s) of different thickness.

There is one other undesirable consequence in the use of the present leaf spring holders in comparison with the holder 30 of FIGS. 1–4. The spring force exerted by the leaf springs will not contain just within the holder but also spill over to its surroundings. Both the back board and the turn buttons will always be under the stress. It may in the long run cause the bulging of the back board and/or damage to the turn buttons and its fastening means. This is especially true if the frame is always maintained at the maximum holding force.

The invention having thus been described, the following is claimed:

1. A device for holding one or more sheets, comprising:
(A) a cam-based holder having:
(a) a holder base,
(b) a rotatable member rotatable with respect to said holder base between
(1) a first zone and
(2) a second zone adjacent to said first zone,
(c) a compression spring for executing a cam action, and
(d) a pin,
said rotatable member having a first sleeve partially wrapping said pin,
said holder base having a second sleeve partially wrapping said pin,
said rotatable member being rotatable, by applying an external force, between
(i) said first zone for activating said cam action whereby said compression spring imparts a torque to said rotatable member for detachably holding said one or more sheets in said device, and
(ii) said second zone in which said rotatable member is detached from said one or more sheets and will remain in said second zone once said applied external force is removed.

2. The device of claim 1 in which
(i) said first sleeve of said rotatable member has a cut-out, and
(ii) said cam-based holder also has a plunger for
(1) retaining said compression spring, and
(2) engaging with said cut-out and said compression spring for driving a rotative motion of said rotatable member.

3. The device of claim 2 in which said plunger has a ramp surface engageable with said cut-out for driving said rotative motion of said rotatable member.

4. A device for holding one or more sheets, comprising:
(A) a sheet holder having:
(a) a holder base,
(b) a rotatable member rotatable with respect to said holder base (1) within a first zone, (2) within a second zone adjacent to said first zone, and (3) between said first zone and said second zone, and (c) a spring for imparting a torque to said rotatable member for detachably holding said one or more sheets in said device, and (d) a pin, said rotatable member having a first sleeve partially wrapping said pin, said holder base having a second sleeve partially wrapping said pin for facilitating the rotation of said rotatable member with respect to said holder base, said rotatable member being rotatable, by applying an external force, between (i) said first zone in which said spring imparts said torque to said rotatable member for detachably holding said one or more sheets in said device, and (ii) said second zone in which said rotatable member is detached from said one or more sheets and will remain stationary anywhere in said second zone once said external force is removed.

5. The device of claim 4 in which (i) said first sleeve of said rotatable member has a cut-out, and (ii) said sheet holder also has a plunger for (1) retaining said spring, and (2) engaging with said cut-out and said spring for driving the rotation of said rotatable member.

6. The device of claim 5 in which said plunger has a ramp surface engageable with said cut-out for driving the rotation of said rotatable member.

7. The device of claim 4 in which said spring is a coil spring.

8. The device of claim 4 in which said spring is a compression spring.

9. The device of claim 4 also comprising:

(B) a picture frame which has a frame body for (a) mounting said sheet holder thereon, and (b) storing said one or more sheets therein, and (c) displaying a sheet of said one or more sheets.

10. The device of claim 9 in which said frame body has a step for mounting said sheet holder thereon.

11. The device of claim 4 in which (i) said second sleeve of said holder base has a cut-out, and (ii) said sheet holder also has a plunger for (1) retaining said spring, and (2) engaging with said cut-out and said spring for driving the rotation of said rotatable member.

12. The device of claim 11 in which said plunger has a ramp surface engageable with said cut-out for driving the rotation of said rotatable member.

13. The device of claim 4 in which said device also comprising:

(B) a holding board for (a) mounting said sheet holder thereon, and (b) displaying a sheet of said one or more sheets.

14. The device of claim 13 in which said device also comprises a leverage member attached to said rotatable member.

15. The device of claim 14 in which said device also comprises a cover for covering said sheet holder, said cover having a slot for exposing at least a portion of said leverage member.

16. The device of claim 13 in which a portion of said holder base is tilted to maximize said torque for holding said one or more sheet on said holding board.

17. The device of claim 4 in which said device also comprising:

(B) a second sheet holder, and (C) a holding board for mounting said sheet holder and said second sheet holder thereon.

18. The device of claim 4 in which said device also comprising:

(B) a second sheet holder for detachably holding said one or more sheets in said device, and (C) a holding board for mounting said sheet holder and said second sheet holder, side by side, thereon.

* * * * *